US009783928B2

(12) United States Patent
Zheng et al.

(10) Patent No.: US 9,783,928 B2
(45) Date of Patent: Oct. 10, 2017

(54) FULL-AUTOMATIC MANUFACTURING METHOD OF PLANT FIBER MOLDED PRODUCT, AND MULTIFUNCTIONAL MACHINE FOR MOLDING AND TRIMMING

(71) Applicants: EURASIA EP MACHINERY CO., LTD., Hangzhou, Zhejiang Province (CN); Tianbo Zheng, Hangzhou, Zhejiang Province (CN); EURASIA MACHINERY MANUFACTURE CO., LTD., Hangzhou, Zhejiang Province (CN); EURASIA LIGHT INDUSTRY EQUIPMENT MANUFACTURE CO., LTD., Hangzhou, Zhejiang Province (CN)

(72) Inventors: Tianbo Zheng, Hangzhou (CN); Shiqin Ding, Hangzhou (CN); Jinjing Li, Hangzhou (CN); Zhuo Zheng, Hangzhou (CN)

(73) Assignees: Eurasia EP Machinery Co, Ltd., Hangzhou (CN); Tianbo Zheng, Hangzhou (CN); Eurasia Machinery Manufacture Co., Ltd., Hangzhou (CN); Eurasia Light Industry Equipment Manufacture Co., Ltd., Hangzhou (CN)

( * ) Notice: Subject to any disclaimer, the term of this patent is extended or adjusted under 35 U.S.C. 154(b) by 2 days.

(21) Appl. No.: 14/443,385

(22) PCT Filed: Dec. 17, 2013

(86) PCT No.: PCT/CN2013/089716

§ 371 (c)(1),
(2) Date: May 17, 2015

(87) PCT Pub. No.: WO2014/094603

PCT Pub. Date: Jun. 26, 2014

(65) Prior Publication Data

US 2015/0292154 A1 Oct. 15, 2015

(30) Foreign Application Priority Data

Dec. 19, 2012 (CN) ..... 2012 1 0556597

(51) Int. Cl.
*D21F 9/04* (2006.01)
*D21J 5/00* (2006.01)
(Continued)

(52) U.S. Cl.
CPC ..... *D21F 9/04* (2013.01); *B26F 1/40* (2013.01); *D21F 7/006* (2013.01); *D21J 5/00* (2013.01);
(Continued)

(58) Field of Classification Search
CPC .... D21F 7/006; D21F 9/04; D21J 5/00; D21J 3/00; B29C 43/00; B29C 43/56;
(Continued)

(56) References Cited

U.S. PATENT DOCUMENTS 3,147,180 A * 9/1964 Berardino ..... D21J 3/00 162/380
3,503,847 A * 3/1970 Modersohn ..... D21J 5/00 162/252
(Continued)

FOREIGN PATENT DOCUMENTS

CN 1214390 A * 4/1999
CN 101914858 A * 12/2010
(Continued)

OTHER PUBLICATIONS

Machine Translation of CN 1214390 A, Published on Apr. 1999.*
Machine Translation of CN 101914858 A, Published on Dec. 2010.*

*Primary Examiner* — Jose Fortuna
(74) *Attorney, Agent, or Firm* — PROI Intellectual Property US

(57) ABSTRACT

Disclosed is a full-automatic method for manufacturing plant-fiber molding products and margin trimming and (Continued)

molding machines. The invention achieves functions: wet semi-finished product forming, hot press mold solidifying, and automatic margin trimming. The full-automatic method is as below: pulps are continuously made into wet semi-finished products by means of a suck-filter forming device, which is alternatively fed into hot-press molds of the left hot-press mold solidifying device and the right hot-press mold solidifying device after being heated to a certain temperature in hot-press molds for hot-press drying and solidifying. The dried and solidified products fall into the left positioning collecting tray and the right positioning collecting tray respectively from the left hot-press top mold and the right hot-press top mold, and are positioned therein. The full-automatic plant-fiber molding, mold solidifying and margin trimming machine includes a forming and solidifying device, a transfer device and a margin trimming device.

10 Claims, 23 Drawing Sheets

(51) Int. Cl.
*B26F 1/40* (2006.01)
*D21F 7/00* (2006.01)
*B26D 7/02* (2006.01)
*B26D 7/06* (2006.01)

(52) U.S. Cl.
CPC ..... *B26D 7/02* (2013.01); *B26D 7/06* (2013.01); *B26F 2210/06* (2013.01)

(58) Field of Classification Search
CPC ..... B26D 7/02; B26D 7/06; B26F 1/40; B26F 2210/06; B29L 2031/3005
USPC ..... 162/218, 226–227
See application file for complete search history.

(56) References Cited

U.S. PATENT DOCUMENTS 3,654,076 A * 4/1972 Hatch ..... B65D 1/34 162/228
3,850,793 A * 11/1974 Hornbostel ..... D21J 5/00 162/228
5,643,384 A * 7/1997 Okabe ..... B31F 1/0077 156/206
5,900,119 A * 5/1999 Goers ..... B65D 81/09 162/218
5,997,785 A * 12/1999 Skjelmose ..... D21F 1/66 162/145
6,210,531 B1 * 4/2001 Bradford ..... B29C 43/56 162/218
6,352,617 B1 * 3/2002 Lee ..... D21J 7/00 162/218
9,144,943 B2 * 9/2015 Spengler ..... B29C 43/04
2003/0136537 A1 * 7/2003 Frederiksen ..... B29C 51/165 162/224
2005/0150624 A1 * 7/2005 Toh ..... D21B 1/00 162/218
2013/0207292 A1 * 8/2013 Spengler ..... B29C 43/04 264/101
2015/0145182 A1 * 5/2015 Jones ..... B29C 70/345 264/571
2015/0292154 A1 * 10/2015 Zheng ..... D21J 5/00 162/226
2016/0168793 A1 * 6/2016 Kuo ..... D21J 3/12 162/227

FOREIGN PATENT DOCUMENTS

GB 2502655 A * 12/2013 ..... B29C 70/345
HK EP 2937462 A1 * 10/2015 ..... D21J 5/00
JP 2001159100 A * 6/2001
KR 20020090502 A * 12/2002

* cited by examiner

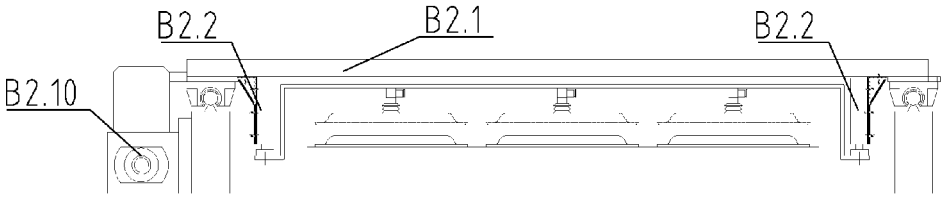
FIG. 7-5. 4
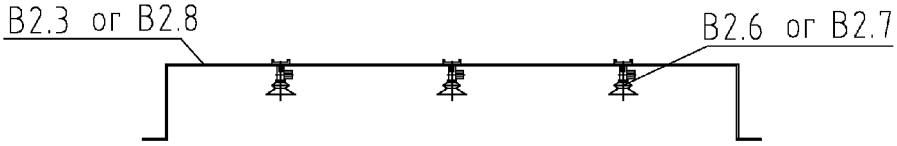
FIG. 7-5. 4. 1
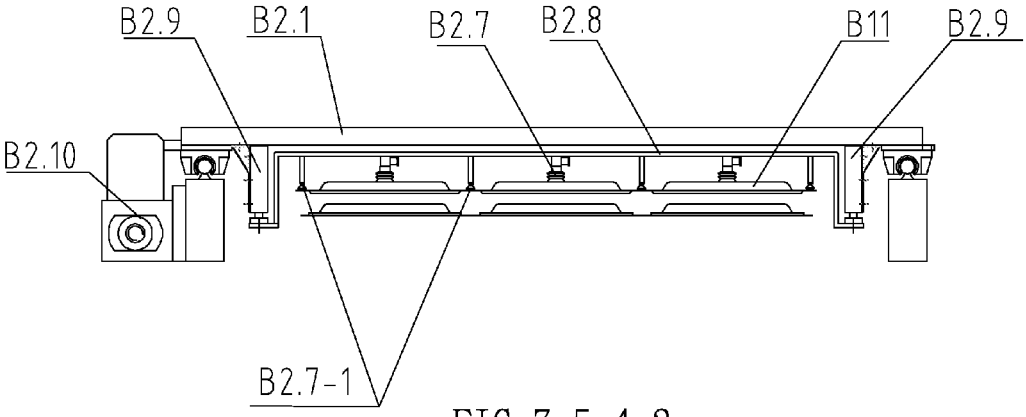
FIG. 7-5. 4. 2

FIG. 7-6.1

FULL-AUTOMATIC MANUFACTURING METHOD OF PLANT FIBER MOLDED PRODUCT, AND MULTIFUNCTIONAL MACHINE FOR MOLDING AND TRIMMING

CROSS REFERENCE TO RELATED APPLICATIONS

The present application is the US national stage of International Patent Application PCT/CN2013/089716 filed on Dec. 17, 2013, which, in turn, claims priority to Chinese Patent Application CN2012 105 565 97.9 filed on Dec. 19, 2012.

BACKGROUND OF THE INVENTION

Technical Field

The present invention relates to a method and device for making plant fiber (referred to as plant fiber hereinafter) products including pulps by pressing and molding; for manufacturing plant-fiber molding products (or pulp molding products, hereinafter collectively referred to as plant-fiber molding products), especially for manufacturing non-planar paper products; such as plant fiber tableware, plant fiber trays, industrial plant-fiber shock pads, packaging boxes and trays, non-planar three-dimensional decorative plant-fiber wall panels (or referred to as three-dimensional plant fiber wallpapers or three-dimensional pulp molding wallpapers) and all plant-fiber molding products.

Description of Related Art

The process for making plant-fiber molding products is as follows: plant fibers are made into wet semifinished products by means of a suck-filter forming device after suck-filter forming, which will be alternatively fed into hot-press molds of the left hot press mold solidifying device and the right hot press mold solidifying device on both sides of the suck-filter forming device after being heated to a certain temperature for clamping and hot-press mold drying and solidifying, thus making plant-fiber molding products in various shapes. This is the dual hot press mold solidifying device mode of the method for manufacturing plant-fiber molding products.

The present invention is explained by taking the dual hot press mold solidifying device mode of the method for manufacturing plant-fiber molding products as an example. There is a common three-station full-automatic plant-fiber molding machine, comprising a forming and solidifying top rack, a forming and solidifying low rack, a rod for connecting the forming and solidifying top rack and the forming and solidifying low rack, a suck-filter forming device (forming station) arranged between the forming and solidifying low rack, a left hot press mold solidifying device (or referred to as the left solidifying station) with the left hot-press top and low molds and a right hot press mold solidifying device (or referred to as the right solidifying station) with the right hot-press top and low molds on both sides of the suck-filter forming device, wherein a wet semifinished product transfer device is arranged above the suck-filter forming device and fixed on the forming and solidifying top rack with its transfer mold clamp moveable up and down; furthermore, the left and right hot-press low molds alternatively move below the transfer device respectively along the horizontal track of the hot-press low mold driven by power so as to receive the wet semifinished products transferred from such transfer device. After the wet semifinished products are transferred into the left or right hot-pressure low mold and return just below the left or right hot-pressure top mold from the transfer mold, the left hot-press top mold closes with the left hot-pressure low mold downward and implements the hot press mold solidifying for the wet semifinished products (or the right hot-press top mold closes with the right hot-pressure low mold downward and implements the hot press mold solidifying for the wet semifinished products driven by the external force, such as moving the tank or cylinder from the right hot-press top mold) driven by the external force (moving the tank or cylinder from the left hot-press top mold) until the wet semifinished products are dried and solidified to remove the product by mold opening. Repeat the above steps again and again. This is the full-automatic plant fiber (including pulp) molding machine by means of the dual hot press mold solidifying device mode, consisting of "the left hot press mold solidifying device, suck-filter forming device and the right hot press mold solidifying device". For example, the plant fiber molding (including pulp molding) machine disclosed in CN patents 03209714.X, ZL201020283075.2, ZL 201010246235.0, ZL201020283085.6 and other related patents are such typical production units.

The wet semifinished products are dried and solidified to remove the products by mold opening in two ways: 1. the full-automatic pulp molding machine is connected with the left and right conveyor belts on the left hot-press low mold (including a mold mounting plate for mounting the left hot-press low mold) and the right hot-press low mold (including a mold mounting plate for mounting the right hot-press low mold). After the wet semifinished products are heated, dried and solidified, the left hot-press top mold opens and absorbs the products to move upward while the left hot-press low mold moves just below the transfer mold, the left conveyor belt is just below the left hot-press top mold as the left hot-press low mold moves to the right and the products absorbed by the left hot-press top mold fall onto the left conveyor belt; afterward, the left conveyor belt also returns to the original position and turns to deliver the products out of the machine with the left hot-press low mold returning to the original position. Similarly, the right hot-press top mold opens and absorbs the products to move upward while the left conveyor belt is just below the right hot-press top mold as the right hot-press low mold moves to the left just below the transfer mold clamp and the products absorbed by the right hot-press top mold fall onto the right conveyor belt; afterward, the right conveyor belt delivers the products out of the machine with the right hot-press low mold returning to the original position. Therefore, the left and right conveyor belts deliver the product out by wet semifinished product forming and hot press mold solidifying. 2. The left and right conveyor belts are replaced with the left plate and the right plate respectively, wherein the products absorbed by the left and right hot-press top molds are blown on the left and right plates respectively. The products are removed from the left and right plates by artificial collection; the left plate with products can be turned to the left at a certain angle so that the products slide out from the left plate or the right plate with products can be turned to the right at a certain angle so that the products slide out from the right plate.

Thus, the dried and solidified products alternatively fall from the left and right hot-pressure top molds and are delivered out from the left conveyor belt (the left plate) or the right conveyor belt (the right plate).

In the prior art, there is a single-side hot press mold solidifying production device arranged on the left or right (either) side of the suck-filter forming device with the same production process as described above. However, one suck-filter forming device is provided with one hot press mold solidifying device, which is known as the single hot press mold solidifying device mode of the method for manufacturing plant-fiber molding products. Moreover, there is a full-automatic plant fiber molding machine with a multi-function auxiliary device to eliminate the mold dripping of the automatic molding machine. Therefore, the process for making plant fiber molding products (including pulp molding products) includes two main processes and functions, namely wet semifinished product forming and hot press mold solidifying in the prior art.

For various reasons, the actual edge of the plant fiber molding products produced by forming and mold solidifying often fails to achieve the design requirements. In order to achieve the precise shape or profile of products, some margin trimming allowances are allowed for the edge of the pre-margin trimmed products and the excess is removed by margin trimming, thus realizing the required process and method by cutting the products into the required shapes. This process and method is known as margin trimming (processes such as removal of extra product edges, product cutting, slitting of single products in integrated products, product punching, product puncturing, cut marks or indentations left on products are all classified as margin trimming).

Until now, all international methods and devices for making and producing plant fiber molding products are designed so that wet semifinished product forming and hot press mold solidifying can be continuously performed on the same device; scattered products cannot be determined in a fixed position after they slide out from the conveyor belt or the left and right plates via hot press mold solidifying. The rim of plant fiber molding products produced has always some rough edges, with which the products are artificially collected and margin trimmed by a margin trimming machine. A method and device cannot be yet achieved to continuously perform the processes below: from wet semi-finished product forming to hot press mold solidifying and to scrap removal. As a result, intact, margin trimmed and high-quality products cannot be produced on the same machine.

BRIEF SUMMARY OF THE INVENTION

The purpose of the present invention is, by overcoming the above shortcomings in the prior art, to provide a full-automatic method for manufacturing plant-fiber molding products and full-automatic plant-fiber molding, mold solidifying and margin trimming machine; the method and the molding machine have three functions: wet semifinished product forming, hot press mold solidifying and automatic margin trimming, with the realization of advantages including high degree of automation, good quality of products and high production efficiency.

The present invention provides the following technical solutions: the full-automatic method for manufacturing plant-fiber molding products with the process is provided, wherein: pulps are continuously made into wet semifinished products by means of a suck-filter forming device, which will be alternatively fed into hot-press molds of the left hot press mold solidifying device and the right hot press mold solidifying device after being heated to a certain temperature for hot-press drying and solidifying, characterized in that: the dried and solidified products fall into the left positioning collection tray of the left positioning collection device and the right positioning collection tray of the right positioning collection device respectively from the left hot-press top mold and the right hot-press top mold, and are positioned therein, to achieve the purpose of fixing the products in a specific position for transfer and ensure the transfer accuracy of the products to be margin trimmed;

The left positioning collection device delivers the dried and solidified products to be margin trimmed to the left transition station and the right positioning collection device delivers the dried and solidified products to be margin trimmed to the right transition station; the products to be margin trimmed are transferred to the position to be margin trimmed of the margin trimming device by the transfer device positioned on the left transition station and the right transition station, and then the margin trimming device withdraws the products to be margin trimmed from the position to be margin trimmed, delivers them to the margin trimming position for margin trimming, and then delivers the margin trimmed products to the completion position and expels the margin trimmed scrap from the margin trimming position; thus the full-automatic process for manufacturing plant fiber molding products operates continuously starting from making pulps into wet semifinished products by suck-filter forming to delivering the products to the completion position after margin trimming.

The left discharge sucker kit in the transfer device withdraws and absorbs the products to be margin trimmed in the left positioning collection tray on the left transition station through vacuum absorption, delivers such products to the left product receiving station along the left discharge horizontal track, and then to the left storage flipper for realization of flipping the products to be margin trimmed or directly to the positioning tray to be margin trimmed in the left transport vehicle on the left product receiving station; the right discharge sucker kit in the transfer device withdraws and absorbs the products to be margin trimmed in the right positioning collection tray on the right transition station through vacuum absorption, delivers such products to the right product receiving station along the right discharge horizontal track, and then to the right storage flipper for realization of flipping the products to be margin trimmed or directly to the positioning tray to be margin trimmed in the right transport vehicle on the right product receiving station, so that the products to be margin trimmed are re-positioned in the positioning tray to be margin trimmed, thus achieving the transfer of the products to be margin trimmed from front to back.

The left transport vehicle in the transfer device receives the products to be margin trimmed on the left product receiving station and delivers them to the position to be margin trimmed; the right transport vehicle in the transfer device receives the products to be margin trimmed on the right product receiving station and delivers them to the position to be margin trimmed, namely the left and right transport vehicles alternatively deliver the received products to be margin trimmed to the position to be margin trimmed.

The margin trimming device withdraws the products to be margin trimmed from the position to be margin trimmed, delivers them to the margin trimming position for margin trimming, and then delivers the margin trimmed products to the completion position.

Margin trimming molds are mounted in the margin trimming and clamping mechanism of the margin trimming device, comprising a margin trimming top mold and a margin trimming low mold, wherein a positioning block is arranged on the margin trimming low mold to fit the shape of products for determining the product position on the margin trimming low mold.

The margin trimming device delivers the products from the position to be margin trimmed to the margin trimming position, and then to the completion position, of which the process is completed through product withdrawing and absorption with a margin trimming sucker kit.

The margin trimming sucker kit is divided into two spaced kits, namely the front-row margin trimming sucker kit and the back-row margin trimming sucker kit, wherein the front-row margin trimming sucker kit absorbs the products to be margin trimmed on the position to be margin trimmed placed on the front side of the margin trimming mold and transfers them onto the positioning block of the margin trimming low mold, the back-row margin trimming sucker kit absorbs the margin trimmed products on the positioning block of the margin trimming low mold and delivers them out of the margin trimming mold, and then places them on the completion position on the back side of the margin trimming mold.

The margin trimming device performs the process as below:

1) the front-row margin trimming sucker kit (on top of the position to be margin trimmed) moves down to absorb the products to be margin trimmed and moves up to return its original position, while the back-row margin trimming sucker kit (on top of the positioning block of the margin trimming low mold) moves down to absorb the margin trimmed products and moves up to return its original position;

2) the front-row margin trimming sucker kit and the back-row margin trimming sucker kit move backward horizontally with the products withdrawn, the scrap removal mechanism expels the margin trimmed scrap from the margin trimming position;

3) after moving backward horizontally to some distance, the front-row margin trimming sucker kit and the back-row margin trimming sucker kit release the products withdrawn respectively, making the products to be margin trimmed fall onto the margin trimming position while the margin trimmed products onto the completion position; the front-row margin trimming sucker kit and the back-row margin trimming sucker kit move forward horizontally and simultaneously, and then stop horizontal movement when the spaced front-row margin trimming sucker kit and the back-row margin trimming sucker kit are in a position on the front and back side of the margin trimming mold respectively;

4) the margin trimming top mold moves downward from the margin trimming mold to clamp with the margin trimming low mold and remove the rough edges of the products to be margin trimmed; and then the margin trimming top mold moves upward from the margin trimming mold to open the mold;

5) the front-row margin trimming sucker kit and the back-row margin trimming sucker kit continue to move forward horizontally until the front-row margin trimming sucker kit and the back-row margin trimming sucker kit reach to the top of the position to be margin trimmed and the margin trimming position respectively;

6) the front-row margin trimming sucker kit and the back-row margin trimming sucker kit moves down respectively or simultaneously to absorb the products to be margin trimmed and the margin trimmed products and then moves up to return its original position;

then repeat steps 2) to 6) again and again.

A piece or set of scrap blowing rods are adopted to move back and forth make horizontally with the front-row margin trimming sucker kit and the back-row margin trimming sucker kit, wherein the scrap blowing rod blows or moves and blows to blow the scrap off the margin trimming low mold within a period of time when the back-row margin trimming sucker kit absorbs and moves the margin trimmed products to the completion position, without affecting the positioning of the next products to be margin trimmed on the positioning block.

The scrap sucker kit absorbs the margin trimmed scrap from the margin trimming mold and then removes it out of the margin trimming mold without affecting the positioning of the next products to be margin trimmed on the positioning block.

The full-automatic plant-fiber molding, mold solidifying and margin trimming machine, includes a forming and solidifying device A for making products to be margin trimmed, a transfer device C for transferring the products to be margin trimmed to the position to be margin trimmed of the margin trimming device and a margin trimming device B for margin trimming of the products to be margin trimmed.

The forming and solidifying device comprises a suck-filter forming device A2, a transfer device A7 for withdrawing wet semifinished products from the suck-filter forming device, a left hot press mold solidifying device A3 and a right hot press mold solidifying device A4 for receiving, heating and drying wet semifinished products respectively, a left positioning collection device A5 for receiving the products to be margin trimmed in the left hot press mold solidifying device and delivering them to the left transition station, and a right positioning collection device A6 for receiving the products to be margin trimmed in the right hot press mold solidifying device and delivering them to the right transition station.

The left hot press mold solidifying device and the right hot press mold solidifying device are symmetrically arranged on the left and right sides of the suck-filter forming device; the left positioning collection device is arranged on the left side of the left hot press mold solidifying device and fixed onto the mounting plate of the left hot-press low mold together with the left hot-press low mold in such device, wherein the mounting plate can move to the left and right horizontally through a slider to position on the horizontal track (A8) of the hot-press low mold; the right positioning collection device is arranged on the right side of the right hot press mold solidifying device and fixed onto the mounting plate of the right hot-press low mold together with the right hot-press low mold in such device, wherein the mounting plate can move horizontally to the left and right through a slider to position on the horizontal track (A8) of the hot-press low mold.

The left positioning collection device and the right positioning collection device are mounted with positioning collection trays (A5.1, A6.1) corresponding with the products on the hot-pressure top mold.

The transfer device comprises a left discharge mechanism C1, a right discharge mechanism C2, a left storage flipper C4 for receiving products transferred by the left discharge sucker kit of the left discharge mechanism to the positioning tray to be margin trimmed on the left transport vehicle after being flipped 180-degrees, a right storage flipper C5 for receiving products transferred by the right discharge sucker kit of the right discharge mechanism to the positioning tray to be margin trimmed on the right transport vehicle after being flipped 180-degrees and a mechanism C3 for alternatively feeding products to be margin trimmed;

If flipping is not required for the products, the transfer device has the structure below after removing the left and right storage flippers; the transfer device comprises a left discharge mechanism, a right discharge mechanism, a positioning tray to be margin trimmed which is mounted on the left transport vehicle for receiving products transferred by the left discharge sucker kit of the left discharge mechanism, a positioning tray to be margin trimmed which is mounted on the right transport vehicle for receiving products transferred by the right discharge sucker kit of the right discharge mechanism, and a mechanism for alternatively feeding products to be margin trimmed;

The left discharge mechanism comprises a left discharge horizontal track C1.2 arranged between the top of the left transition station and the top of the left product receiving station, a left discharge sucker kit C1.1 that moves along the left discharge horizontal track through a slider and delivers the products to be margin trimmed in the left positioning collection tray to the left product receiving station, and a left power transmission mechanism for driving the left discharge sucker kit; the right discharge mechanism comprises a right discharge horizontal track C2.2 arranged between the top of the right transition station and the top of the right product receiving station, a right discharge sucker kit C2.1 that moves along the right discharge horizontal track through a slider and delivers the products to be margin trimmed in the right positioning collection tray to the right product receiving station, and a right power transmission mechanism for driving the right discharge sucker kit;

The mechanism for alternatively feeding products to be margin trimmed comprises a transport vehicle track C3.3 arranged between the left product receiving station, the position to be margin trimmed and the right product receiving station, a left transport vehicle C3.1 for delivering the products to be margin trimmed on the left product receiving station to the position to be margin trimmed along the transport vehicle track, a right transport vehicle C3.2 for delivering the products to be margin trimmed on the right product receiving station to the position to be margin trimmed along the transport vehicle track, a power transmission mechanism for driving the transport vehicle, so as to deliver the products to be margin trimmed to the position to be margin trimmed alternatively by the left and right transport vehicles.

The left and right discharge sucker kits are mounted with at least a sucker for withdrawing and absorbing products through vacuum absorption respectively.

The left and right transport vehicles are mounted with a positioning tray to be margin trimmed C3.4 for accurate positioning of the products to be margin trimmed; the positioning tray to be margin trimmed, the left positioning collection tray and the right positioning collection tray are trays for guiding and positioning with the shape completely or partially matching with the products, or metallic or non-metallic molds with the shape matching with the products, or cavity plates with guide sheets allowing products partially into the cavities, limiting rings, limiting rods, limiting utensils, limiting devices and metallic or non-metallic plate assemblies for limiting the rim of the products or other devices for guiding and positioning of the products.

The margin trimming device comprises a margin trimming and clamping mechanism B1 positioned on the rack, a product transfer mechanism B2, a scrap removal mechanism; the margin trimming and clamping mechanism includes a margin trimming top mold B1-2, a margin trimming low mold B1-1, a mounting plate B1-3 with a margin trimming top mold, a mounting plate B1-4 with a margin trimming low mold, a power mechanism for driving the clamping movement of the mounting plates of the margin trimming top and low molds; a positioning block B1-1.2 is also arranged on the margin trimming low mold to fit the shape of products for facilitating positioning of the products to be margin trimmed.

The product transfer mechanism comprises a front-row margin trimming sucker kit (B2.6) for absorbing the products to be margin trimmed on the position to be margin trimmed and transferring to the margin trimming low mold, a back-row margin trimming sucker kit B2.7 for absorbing the margin trimmed products and delivering out of the margin trimming low mold, a front sucker fixing plate B2.3 for fixing the front-row margin trimming sucker kit, a back sucker fixing plate B2.8 for fixing the back-row margin trimming sucker kit, a transport rack (B2.1) for driving the front and back sucker fixing plates to move back and forth, a horizontal driving device B2.10 for driving horizontal movement of the transport rack.

The transport rack has a frame structure, wherein the front-row and back-row margin trimming sucker kits are fixed onto the front and back sucker fixing plates respectively with their openings facing downward, and respectively mounted on the front and rear sides of the transport rack at a distance through a front suction cylinder B2.2 and a back suction cylinder B2.9, so that the front-row and back-row margin trimming sucker kits can move up and down driven by the front and back suction cylinders.

The margin trimming device is also provided with a spaced transfer track B2.4 for the transport rack to move back and forth horizontally through a slider B2.5.

The scrap removal mechanism comprises a scrap blowing rod B14 mounted on the transport rack for blowing the margin trimmed scrap off the margin trimming low mold and connecting the gas line with a control valve to the gas supply, wherein the margin trimming device is also mounted with a control switch for opening and closing the control valve so as to open the control valve and turn on the gas supply during blowing of the scrap, close the control valve and turn off the gas supply during stopping blowing of the scrap; or a set of scrap sucker kits are mounted near the back-row margin trimming sucker kit B2.7 for withdrawing and absorbing the scrap to absorb the scrap and deliver out of the margin trimming low mold, or a set of pliers B13 or hooks or clamps are arranged on the front and back sides of the margin trimming low mold for clamping, hooking and holding the scrap, or a set of pliers or hooks or clamps are arranged on either side (the front or back side) of the margin trimming low mold for clamping, hooking and holding the scrap.

The horizontal driving device B2.10 is driven by a motor and a screw mechanism to drive the transport rack to move back and forth horizontally on the transfer track or stop at a specific position, or driven by a motor, synchronous belt or belt or chain to drive the transport rack to move back and forth horizontally or stop at a specific position, or driven by a cylinder or tank to drive the transport rack to move back and forth horizontally or stop at a specific position.

The product transfer mechanism is a rod-type product transfer mechanism for driving the transport rack to move back and forth horizontally on the transfer track, comprising a front-row margin trimming sucker kit B2.6 for absorbing the products to be margin trimmed on the position to be margin trimmed and transferring to the margin trimming low mold, a back-row margin trimming sucker kit B2.7 for absorbing the margin trimmed products and delivering out of the margin trimming low mold, a front sucker fixing plate B2.3 for fixing the front-row margin trimming sucker kit, a back sucker fixing plate B2.8 for fixing the back-row margin trimming sucker kit, a transport rod B19 arranged on either side of the margin trimming mold for driving the front and back sucker fixing plates to move back and forth or up and down, a swing device B17 for driving the transport rod to move up and down, a horizontal driving device B2.10 for driving horizontal movement of the transport rod; one end of the front sucker fixing plate and the back sucker fixing plate is fixed on one side of the transport rod at a distance, wherein a space greater than the profile of the margin trimming top mold is reserved between the front row sucker kit and the back row sucker kit so that the transport rod can be slidably fixed on the two swing devices.

The rod-type product transfer mechanism is also provided with a sliding connection B20 that can slide up and down on a slide B18 for driving the transport rod to move back and forth horizontally; the slide can move horizontally on two transfer tracks arranged vertically; the horizontal driving device is driven by a motor and a screw mechanism to drive the transport rack to move back and forth horizontally or stop at a specific position, or driven by a motor, synchronous belt or belt or chain to drive the transport rack to move back and forth horizontally or stop at a specific position; or driven by a cylinder or tank to drive the transport rack to move back and forth horizontally or stop at a specific position.

The scrap removal mechanism comprises a scrap blowing rod B14 mounted on the transport rod for blowing the margin trimmed scrap off the margin trimming low mold and connecting the gas line with a control valve to the gas supply, wherein the margin trimming device is also mounted with a control switch for opening and closing the control valve so as to open the control valve and turn on the gas supply during blowing of the scrap, close the control valve and turn off the gas supply during stopping blowing of the scrap; or a set of scrap sucker kits are mounted near the back-row margin trimming sucker kit B2.7 for withdrawing and absorbing the scrap to absorb the scrap and deliver out of the margin trimming low mold, or a set of pliers B13 or hooks or clamps are arranged on the front and back sides of the margin trimming low mold for clamping, hooking and holding the scrap, or a set of pliers or hooks or clamps are arranged on either side (the front or back side) of the margin trimming low mold for clamping, hooking and holding the scrap.

The working principle of the present invention is below: plant fibers are made into wet semifinished products by means of a suck-filter forming device, which will be alternatively fed into hot-press molds of the left hot press mold solidifying device and the right hot press mold solidifying device after being heated to a certain temperature for clamping and hot-press drying and solidifying, and then the dried and solidified products (products to be margin trimmed) fall into the left positioning collection tray and the right positioning collection tray of the left positioning collection device and the right positioning collection device respectively from the left hot-press top mold and the right hot-press top mold. The products falling from the hot-press top mold are positioned in the positioning collection tray and regularly arranged in the positioning collection device (the positioning collection tray is arranged on the positioning collection device corresponding with the products on the hot-pressure top mold). Next, the transfer device alternatively delivers the products to the position to be margin trimmed of the margin trimming device after such products are regularly arranged in the left and right positioning collection devices; delivers the products to be margin trimmed to the automatic margin trimming position for margin trimming, and then transfers the margin trimmed products to the completion position, while the margin trimmed scrap is removed out of the margin trimming mold.

The favorable effect of the present invention is that: with the positioning collection device and the transfer device, the suck-filter forming device can be integrated with the margin trimming device perfectly, thus achieving the continuous integration production from wet semifinished product forming to hot press mold solidifying to scrap removal; not only greatly improving the production efficiency (at least three times), reducing the labor intensity, but also significantly reducing the production cost.

BRIEF DESCRIPTION OF THE SEVERAL VIEWS OF THE DRAWINGS

FIG. 4.1 shows the schematic view of the front structure of the suck-filter forming device with the flipping "pulp collection method".

FIG. 5.1 shows the schematic view of the left structure of the full-automatic plant-fiber molding, mold solidifying and margin trimming machine after the forming and solidifying device is removed.

FIG. 5.2 shows the schematic view of the cross-sectional structure of the B-B in FIG. 5 of the full-automatic plant-fiber molding, mold solidifying and margin trimming machine.

FIG. 6-1 shows the schematic view of the three-dimensional structure of the plant-fiber molding product margin trimming device under the operating state 1 (when the products to be margin trimmed and the margin trimmed products are just withdrawn and absorbed).

FIG. 6-2 shows the schematic view of the three-dimensional structure of the plant-fiber molding product margin trimming device under the operating state 2 (during transfer of the products to be margin trimmed and the margin trimmed products).

FIG. 6-3 shows the schematic view of the three-dimensional structure of the plant-fiber molding product margin trimming device under the operating state 3 (during transfer of the products to be margin trimmed to the top of the margin trimming low mold).

FIG. 7-1 shows the schematic view of the front structure of the plant-fiber molding product margin trimming device.

FIG. 7.2 shows the schematic view of the cross-sectional structure of the A-A in FIG. 7-1 (not including the scrap removal device).

FIG. 7.3 shows the schematic view of the left structure of the scrap removal device (after the product transfer mechanism is removed) of the plant-fiber molding product margin trimming device.

FIG. 7.4 shows the schematic view of the overhead structure of the scrap removal device of the plant-fiber molding product margin trimming device.

FIG. 7-5.1 shows the schematic view of the front structure of the two-plate margin trimming and clamping mechanism.

FIG. 7-5.2 shows the schematic view of the front structure of one embodiment of the three-plate margin trimming and clamping mechanism.

FIG. 7-5.3 shows the schematic view of the front structure of the second embodiment of the three-plate margin trimming and clamping mechanism.

FIG. 7-5.4 shows the schematic view of the front structure of the product transfer mechanism in the margin trimming device.

FIG. 7-5.4.1 shows the schematic view of the front structure of the front sucker fixing plate and the back sucker fixing plate of the product transfer mechanism in FIG. 7-5.4.

FIG. 7-5.4.2 shows the schematic structural view of the product transfer mechanism with scrap sucker kits.

FIG. 7-6.1 shows the schematic view of the front structure of the margin trimming device with a rod-type product transfer mechanism.

FIG. 7-6.2 shows the schematic view of the left structure of the margin trimming device with a rod-type product transfer mechanism.

FIG. 7-6.3 shows the schematic view of the partial overhead structure of the rod-type product transfer mechanism with a scrap blowing rod.

FIG. 7-6.4 shows the schematic view of the partial overhead structure of the scrap removal mechanism and the rod-type product transfer mechanism by means of scrap sucker kits.

FIG. 7-7 shows the schematic view of the overhead structure of the frame-type product transfer mechanism in the margin trimming device.

BRIEF DESCRIPTION OF THE REFERENCE NUMERALS OF MAJOR COMPONENTS

A—forming and solidifying device; B—margin trimming device; C—transfer device; A1—rack; A1*a*—forming and solidifying low rack; A1*b*—forming and solidifying top rack; A1*c*—rod; A2—suck-filter forming device (or referred to as the forming station); A1*a*—suck-filter forming pulp tank; A2*c*—suck-filter forming molds; A3—left hot press mold solidifying device (or referred to as the left positioning station); A3*a*—left hot-press top mold; A3*b*—moving cylinder of the left hot-press top mold; A3*c*—left hot-press low mold; A4—left hot press mold solidifying device (or referred to as the right positioning station); A4*a*—right hot-press top mold; A4*b*—moving cylinder of the right hot-press top mold; A4*c*—right hot-press low mold; A5—left positioning collection device; A5.1—left positioning collection tray; A6—right positioning collection device; A6.1—right positioning collection tray; A7—wet semifinished products transfer device; A7*a*—wet semifinished products transfer mold; A7*b*—moving cylinder of the wet semifinished products transfer mold; A8—horizontal track of the hot-press low mold; A9—flipping axis of the suck-filter forming molds; product—S.

B1—margin trimming and clamping mechanism; B1-1—margin trimming low mold; B1-1.1—margin trimming low mold body; B1-1.2—positioning block; B1-2—margin trimming top mold; B1-3—mounting plate of the margin trimming top mold; B1-4—mounting plate of the margin trimming low mold; B1-5—clamping rod; B1-6—rack; B1-7—fixed mold clamp; B2—product transfer mechanism; B2.1—transport rack; B2.2—front suction cylinder; B2.3—front sucker fixing plate; B2.4—transfer track; B2.5—slider; B2.6—front—row margin trimming sucker kit; B2.7—back—row margin trimming sucker kit; B2.7—1—scrap sucker kit; B2.8—back sucker fixing plate; B2.9—back suction cylinder; B2.10—horizental moving device; B10—products to be margin trimmed; B11—margin trimmed products; B12—scrap; B13—piler; B14—scrap blowing rod; B15—tank (cylinder or liquid pressurized cylinder); B16—guide rod; B17—swing device (up and down); B17.1—swing slide; B17.2—swing sleeve guide; B17.3—swing cylinder; B17.4—swing rod; B18—slide; B19—transport rod; B20—sliding connection.

C1—left discharge mechanism, C1.1—left discharge sucker kit, C1.2—left discharge horizontal track, C2—right discharge mechanism, C2.1—right discharge sucker kit, C2.2—right discharge horizontal track, C3—mechanism for alternatively feeding products to be margin trimmed, C3.1—left transport vehicle, C3.2—right transport vehicle, C3.3—transport vehicle track, C3.4—positioning tray to be margin trimmed; C4—left storage flipper, C4.1, C5.1—flipping sucker kit, C5—right storage flipper.

DETAILED DESCRIPTION OF THE INVENTION

Embodiment 1

Figure 1:
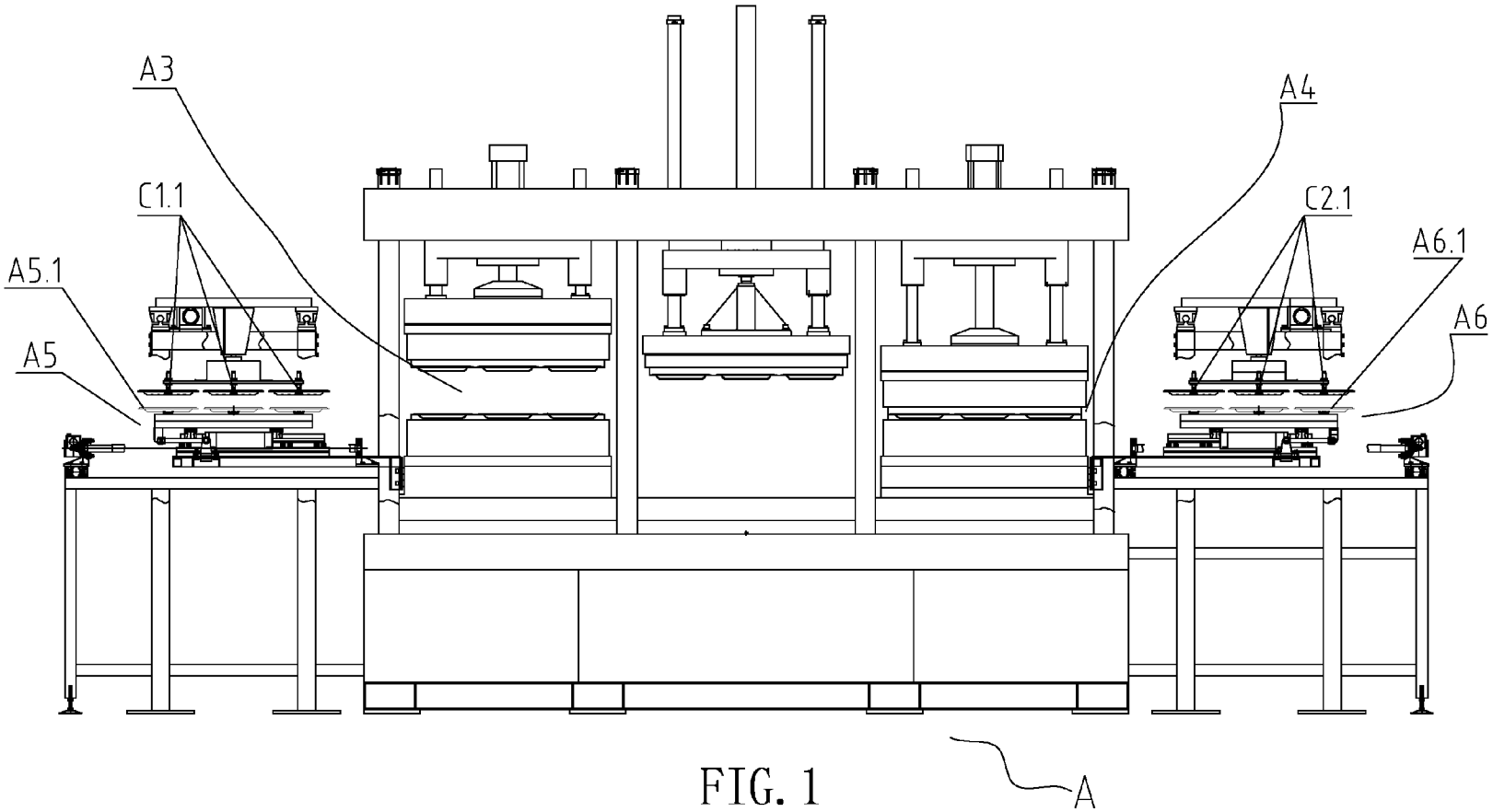
FIG. 1 shows the schematic view of the front structure of the full-automatic plant-fiber molding, mold solidifying and margin trimming machine (dual hot press mold solidifying device mode) according to the present invention.
Figure 2:
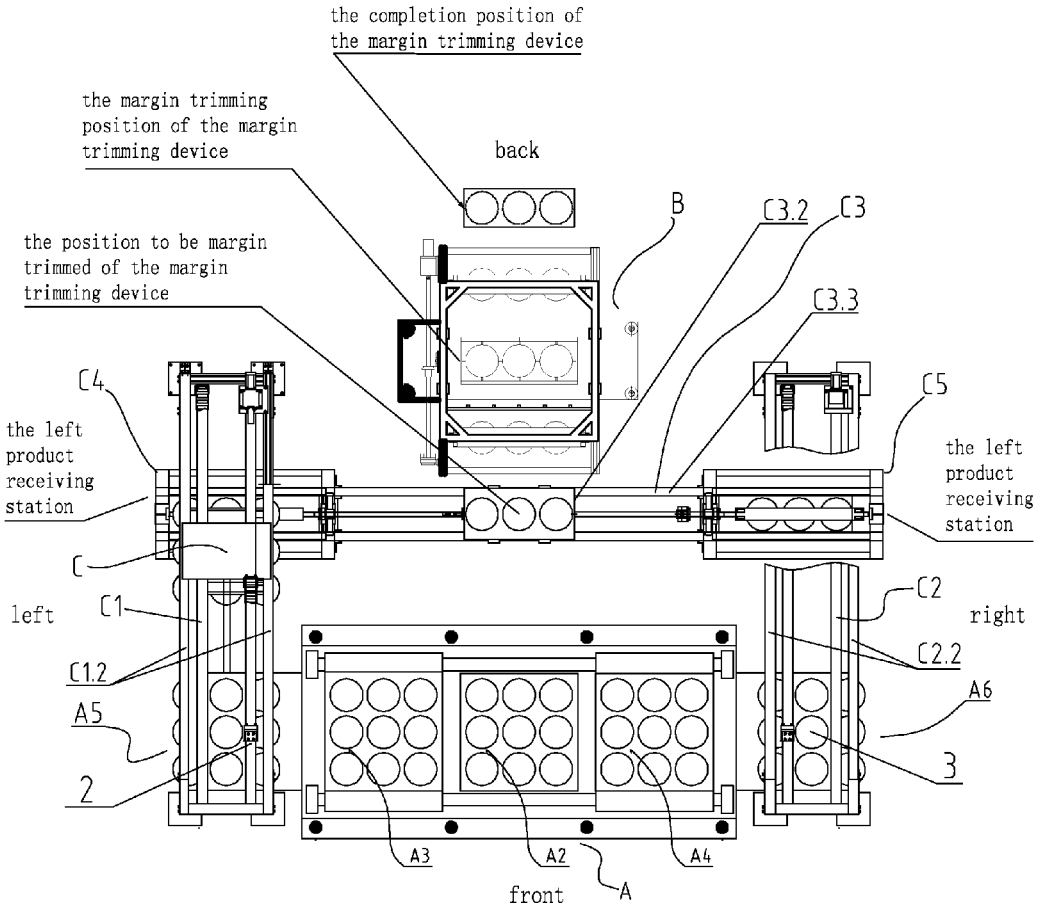
FIG. 2 shows the schematic view of the overhead structure of the full-automatic plant-fiber molding, mold solidifying and margin trimming machine (dual hot press mold solidifying device mode) according to the present invention.
Figure 3:
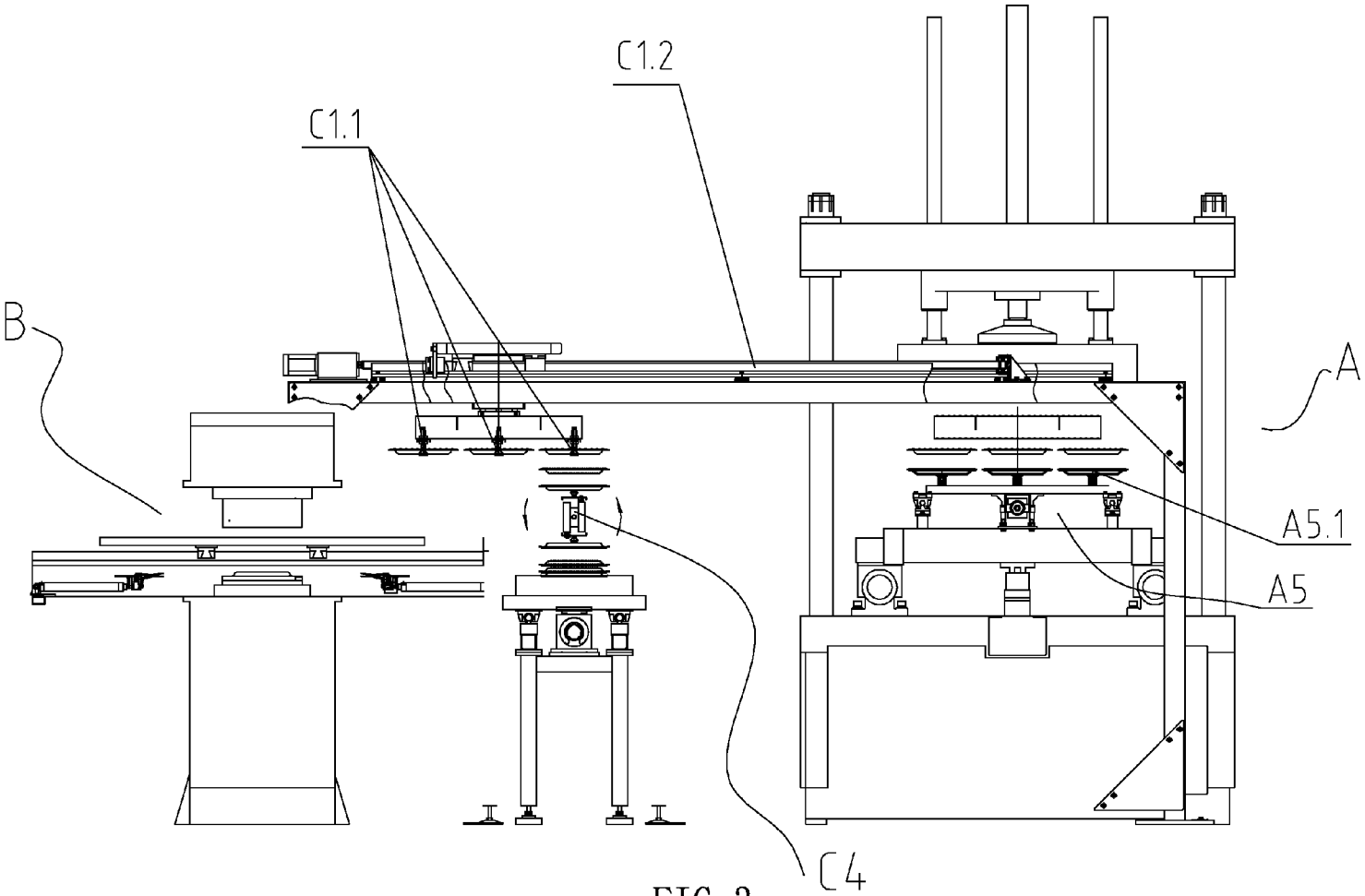
FIG. 3 shows the schematic view of the left structure of the full-automatic plant-fiber molding, mold solidifying and margin trimming machine (dual hot press mold solidifying device mode) according to the present invention.

As shown in FIGS. 1, 2 and 3, the full-automatic plant-fiber molding, mold solidifying and margin trimming machine includes a forming and solidifying device A, a transfer device C and a margin trimming device B.

Figure 4:
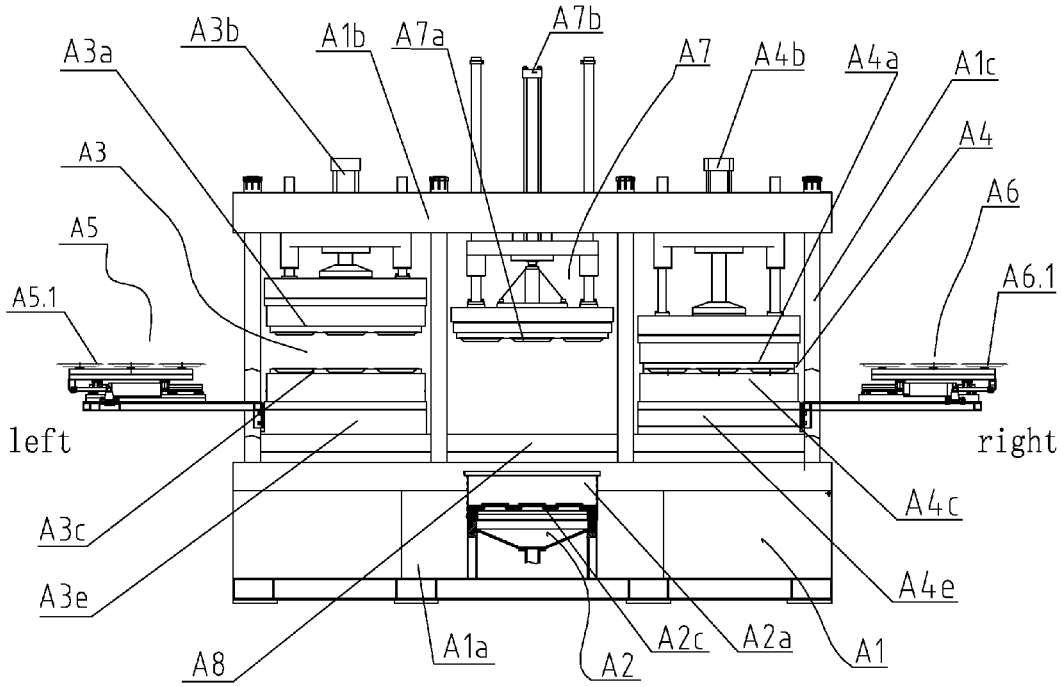
FIG. 4 shows the schematic view of the front structure of the forming and solidifying device.
Figure 4:
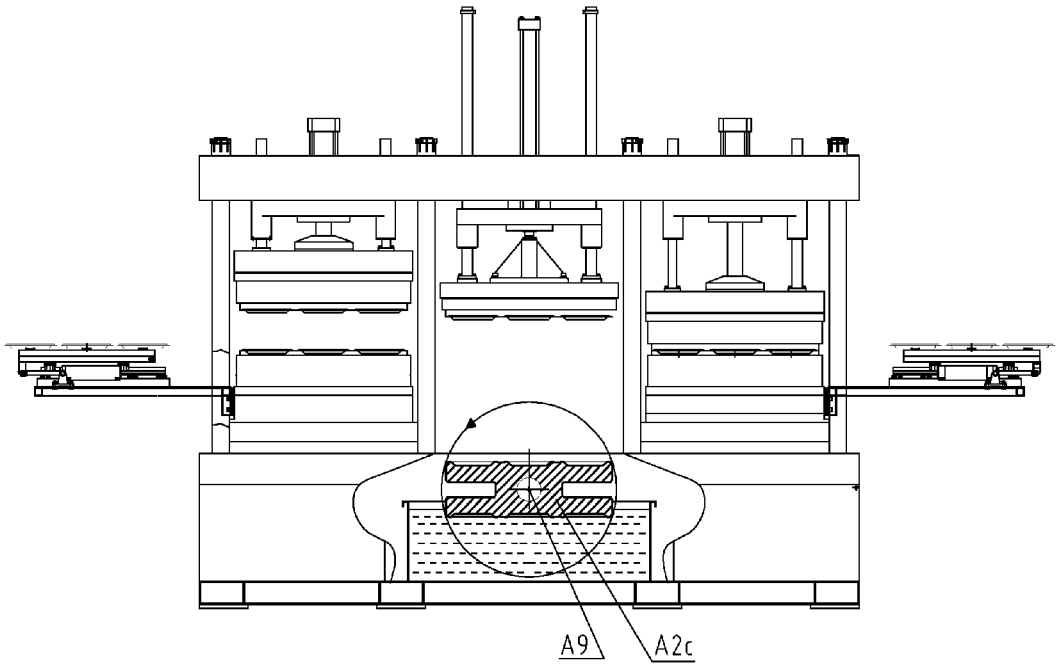

The forming and solidifying device (as shown in FIG. 4) includes a rack A1 composed of a rod A1*c*, a forming and solidifying low rack A1*a* and a forming and solidifying top rack A1*b*; a suck-filter forming device A2 arranged between the forming and solidifying low rack, a left hot press mold solidifying device A3 with a left hot-press top mold A3*a* and a left hot-press top mold A3*c* on the left side of the device, a right hot press mold solidifying device A4 with a right hot-press top mold A4*a* and a right hot-press top mold A4*c* on the right side of the device. The mounting plate A3*e* of the left hot-press low mold and the mounting plate A4*e* of the right hot-press low mold are connected to a left positioning collection device A5 and a right positioning collection device A6 respectively; the left positioning collection device is fixed on the left side of the mounting plate of the left hot-press low mold, wherein the device can move horizontally to the left and right together with the mounting plate and the left hot-press low mold along the horizontal track A8 of the hot-press low mold; the right positioning collection device A6 is fixed on the right side of the mounting plate of the right hot-press low mold, wherein the device can move horizontally to the left and right together with the mounting plate and the right hot-press low mold along the horizontal track A8 of the hot-press low mold (the mounting plate of the left hot-press low mold can slide to the left and right through a slider to position on the horizontal track A8 of the hot-press low mold; the mounting plate of the right hot-press low mold can slide to the left and right through a slider to position on the horizontal track A8 of the hot-press low mold). The left positioning collection device is mounted with a left positioning collection tray A5.1; the right positioning collection device is mounted with a right positioning collection tray A6.1.

The suck-filter forming device A2 comprises a suck-filter forming molds A2*c* and a suck-filter forming pulp tank. The mixture (referred to as the pulp) of plant fibers with water evenly or roughly distributed in water with an appropriate concentration is intermittently or continuously injected into the suck-filter forming pulp tank; the suck-filter forming molds penetrates into the pulp of the suck-filter forming pulp tank or is fixed at the bottom of the pulp tank for suction. When the suck-filter forming molds absorbs a number of plant fibers, the mold will be exposed above the level and made into wet semifinished products. The wet semifinished products are alternatively fed into hot-press molds of the left hot press mold solidifying device A3 and the right hot press mold solidifying device A4 on the left and right sides of the suck-filter forming device after being heated to a certain temperature for clamping and hot-press drying and solidifying.

The specific structure (as shown in FIG. 4) is: the suck-filter forming molds A2*c* is fixed at the bottom of the suck-filter forming pulp tank; the mold is provided with one or more cavities (the mold cavity has the consistent shape with the product, wherein the suck-filter forming molds and the wet semifinished products transfer mold A7*a* are mutually fitting concave and convex molds, namely, the cavities of the former are concave molds while those of the latter are convex molds; vice versa) for pre-making wet semifinished products, a number of drainage holes are arranged in such cavities, and wire meshes are attached onto the cavity surface with the shape fitting the shape of the cavity surface, the drainage hole, wherein such drainage holes are connected to negative-pressure devices (such as vacuum pumps) by means of pipes mounted with control valves, the forming and solidifying device is also mounted with a control switch to open and close the control valve so as to generate negative pressure during suck-filter forming and relieve negative pressure at the end of suck-filter forming. The pulp is injected into the suck-filter forming pulp tank to a fixed amount in the suck-filter forming device; during suck-filter forming, the negative pressure is connected to the drainage hole in the suck-filter forming molds cavity, wherein pulp water is discharged from the drainage hole of the suck-filter forming molds under the action of the negative pressure, fibers are absorbed onto the wire mesh of the cavity; the level decreases continuously as the pulp reduces, when the wet semifinished products and the suck-filter forming molds expose above the level. Fibers absorbed onto the wire mesh of the cavity form into the shape of products and are pre-made into wet semifinished products with an expected thickness; the wet semifinished products are further removed with excess water and left in the cavity at the end of suck-filter forming after appropriate moisture content is achieved. During making of wet semifinished products, it is known as the "pulp injection method" for suck-filter forming (conventional method) as the suck-filter forming molds and the pulp tank are fixed.

Alternatively, three ways may also be employed to achieve suck-filter forming: 1. during circulation, pulps continuously flow into the suck-filter forming pulp tank externally and continuously overflow into the external pulp pool, wherein the pulp level keeps essentially unchanged in the suck-filter forming pulp tank, the suck-filter forming molds can move up and down relative to the suck-filter forming pulp tank. During suck-filter forming, the suck-filter forming molds is arranged below the level, pulp water is discharged and pumped from the cavity drainage hole of the suck-filter forming molds under the action of the negative pressure, and fibers are absorbed onto the wire mesh of the cavity and begin to form wet semifinished products; at the end of suck-filter forming, the suck-filter forming molds sucks filtration while rising in the pulp until it is exposed above the level; the suck-filter forming molds exposed leaves wet semifinished products in the cavity and water are further removed; such wet semifinished products are formed at the end of suck-filter forming after appropriate moisture content is achieved. With this approach, the suck-filter forming pulp tank is fixed and the suck-filter forming molds sucks filtration while rising until the wet semifinished products and the suck-filter forming molds expose above the level to reach a certain position, which is known as the "pulp collection method" for suck-filter forming by means of which the suck-filter forming molds can move up and down while the suck-filter forming pulp tank is fixed. 2. During circulation, pulps continuously flow into the suck-filter forming pulp tank externally and continuously overflow into the external pulp pool, wherein the pulp level keeps essentially unchanged in the suck-filter forming pulp tank, the suck-filter forming pulp tank can move up and down relative to the suck-filter forming molds fixed. During suck-filter forming, the suck-filter forming molds is arranged below the pulp level, partial pulp water is discharged and pumped from the cavity drainage hole of the suck-filter forming molds under the action of the negative pressure, and fibers are absorbed onto the wire mesh of the cavity and begin to form the wet semifinished products; at the end of suck-filter forming, the suck-filter forming pulp tank declines while the level also declines relative to the suck-filter forming molds until the suck-filter forming molds exposes above the level; the suck-filter forming molds exposed leaves wet semifinished products in the cavity and the cavity water are further removed, wherein such wet semifinished products are formed at the end of suck-filter forming after appropriate moisture content is achieved. With this approach, the suck-filter forming molds is fixed while the suck-filter forming pulp tank moves up and down relative to the suck-filter forming molds, which is known as the "pulp collection method" for suck-filter forming by means of which the suck-filter forming pulp tank moves while the suck-filter forming molds is fixed. 3. During circulation as shown in FIG. 4.1, pulps continuously flow into the fixed suck-filter forming pulp tank externally and continuously overflow into the external pulp pool, wherein the suck-filter forming molds can rotate 180-degrees around the flipping axis A9 of the suck-filter forming molds on which two working surfaces can be provided at an angle of 180-degrees; when a working surface moves downward to absorb pulps, the other working surface delivers the wet semifinished products above the level after suck-filter forming, wherein the two working surfaces alternatively move downward to absorb pulps and make wet semifinished products, and deliver such pulps out of the level until such working surfaces are upward vertically. During suck-filter forming, the suck-filter forming molds flips down into the pulp until the suck-filter forming molds faces downward underneath the pulp level, partial pulp water is discharged and pumped from the cavity drainage hole of the suck-filter forming molds under the action of the negative pressure, and fibers are absorbed onto the wire mesh of the cavity and begin to form the wet semifinished products; at the end of suck-filter forming, the suck-filter forming molds flips upward from the pulp and exposes above the surface gradually until it faces upward and exposes above the level completely; the suck-filter forming molds exposed leaves wet semifinished products in the cavity and water therein is further removed, wherein such wet semifinished products are formed at the end of suck-filter forming after appropriate moisture content is achieved, the wet semifinished products expose above the level from the suck-filter forming molds A2*c* until the working surface is upward vertically; With this approach, the suck-filter forming molds flips up and down around the axis, which is known as the flipping "pulp collection method" for suck-filter forming, which can also be the suck-filter forming molds of the single working surface.

The "pulp injection method" for suck-filter forming and various "pulp collection method" for suck-filter forming (the "pulp collection method" for suck-filter forming by means of which the suck-filter forming molds moves while the suck-filter forming pulp tank is fixed, the "pulp collection method" for suck-filter forming by means of which the suck-filter forming pulp tank moves while the suck-filter forming molds is fixed, the flipping "pulp collection method" for suck-filter forming) are methods for the forming and solidifying device to make wet semifinished products. Plant fibers or pulps are first made into wet semifinished products by suck-filter forming, which will be then alternatively fed into hot-press molds of the left hot press mold solidifying device A3 and the right hot press mold solidifying device A4 for clamping and hot-press drying and solidifying. It is explained by taking the "pulp injection method" for suck-filter forming and the dual hot press mold solidifying device mode as an example. The specific working principle is: after forming of the wet semifinished products, the wet semifinished products transfer mold A7*a* moves downward vertically to the suck-filter forming molds A2*c* for absorbing the wet semifinished products that will be lifted upward in place, and then the left hot-press low mold (or the right hot-press low mold) moves horizontally just below the wet semifinished products transfer mold; the wet semifinished products transfer mold moves downward to transfer such product onto the left hot-press low mold A3*c* (or the right hot-press low mold A4*c*) and rises after completion of transfer; the left hot-press low mold (or the right hot-press low mold) returns to its original position horizontally, the left hot-press top mold A3*a* moves downward to clamp with the left hot-press low mold (or the right hot-press top mold moves downward to clamp with the right hot-press low mold) for hot-press drying and solidifying of the wet semifinished products so as to make dried products, namely products to be margin trimmed.

After the wet semifinished products are heated, dried and solidified in the hot-press mold of the left hot-pressure molding device A3, the left hot-press top mold A3*a* opens and absorbs products to move upward; then the left hot-press low mold moves to the right and the left positioning collection tray A5.1 also moves to the right with such mold. When the left hot-press low mold A3*c* moves just beneath the wet semifinished products transfer mold, it stops moving and receives the wet semifinished products transferred from the wet semifinished products transfer mold while the left positioning collection tray A5.1 just reaches below the left hot-press top mold A3*a*, and products on the left hot-press top mold fall on the left positioning collection tray A5.1 correspondingly; subsequently, the left positioning collection tray A5.1 moves to the left to its original position (the left transition station) as the left hot-press low mold moves to the left to its original position. Similarly, the right hot-press top mold A4*a* opens and absorbs products to move upward; then the right hot-press low mold A4*c* moves to the left and the right positioning collection tray A6.1 also moves to the left with such mold; when the right hot-press low mold reaches just beneath the wet semifinished products transfer mold, it stops moving and receives the wet semifinished products transferred from the wet semifinished products transfer mold while the right positioning collection tray just reaches below the right hot-press top mold, and products on the right hot-press top mold fall on the right positioning collection tray correspondingly; subsequently, the right positioning collection tray moves to the right to its original position (the right transition station) as the right hot-press low mold moves to the right to its original position.

The positioning collection tray mounted on the left and right positioning collection devices can be made from any structure for positioning the products fallen. For example, they can be non-metallic (such as plastic trays) or metallic trays for guiding and positioning with the shape completely or partially matching with the products, or metallic or non-metallic molds with the shape matching with the products, or cavity plates with guide sheets allowing products partially into the cavities, limiting rings, limiting rods, limiting utensils, limiting devices and metallic or non-metallic plate assemblies for limiting the rim of the products (or for limiting) or other devices for guiding and positioning of the products. The number of the positioning collection tray on the positioning collection device is corresponding with that of the products on the hot-press top mold to receive corresponding products, wherein the positioning collection tray can be split structure (the several positioning collection trays are independent from the same positioning collection device) or integrated structure (the several positioning collection trays are integrated on the same positioning collection device). If products are required being re-arranged by the left and right positioning collection devices when products are transferred onto the positioning collection tray from the hot-press top mold due to process requirements, each positioning collection tray shall be split structure, allowing each tray to re-arrange and re-position such products by moving, rotation and other actions.

The left positioning collection tray A5.1 and the right positioning collection tray A6.1 on the left and right positioning collection devices respectively receive products alternatively from the left hot-press top mold A3*a* and the right hot-press top mold A4*a*, wherein such products are arranged, combined and re-positioned according to the margin trimming requirements (such products remain intact if re-arrangement, combination and re-positioning are not required). Thus, the forming and solidifying device completes wet semifinished product forming, hot press mold solidifying, arrangement and positioning of the products.

Products arranged and positioned on the left or the right positioning collection tray require being transferred onto the margin trimming device by the transfer device for margin trimming.

Figure 5:
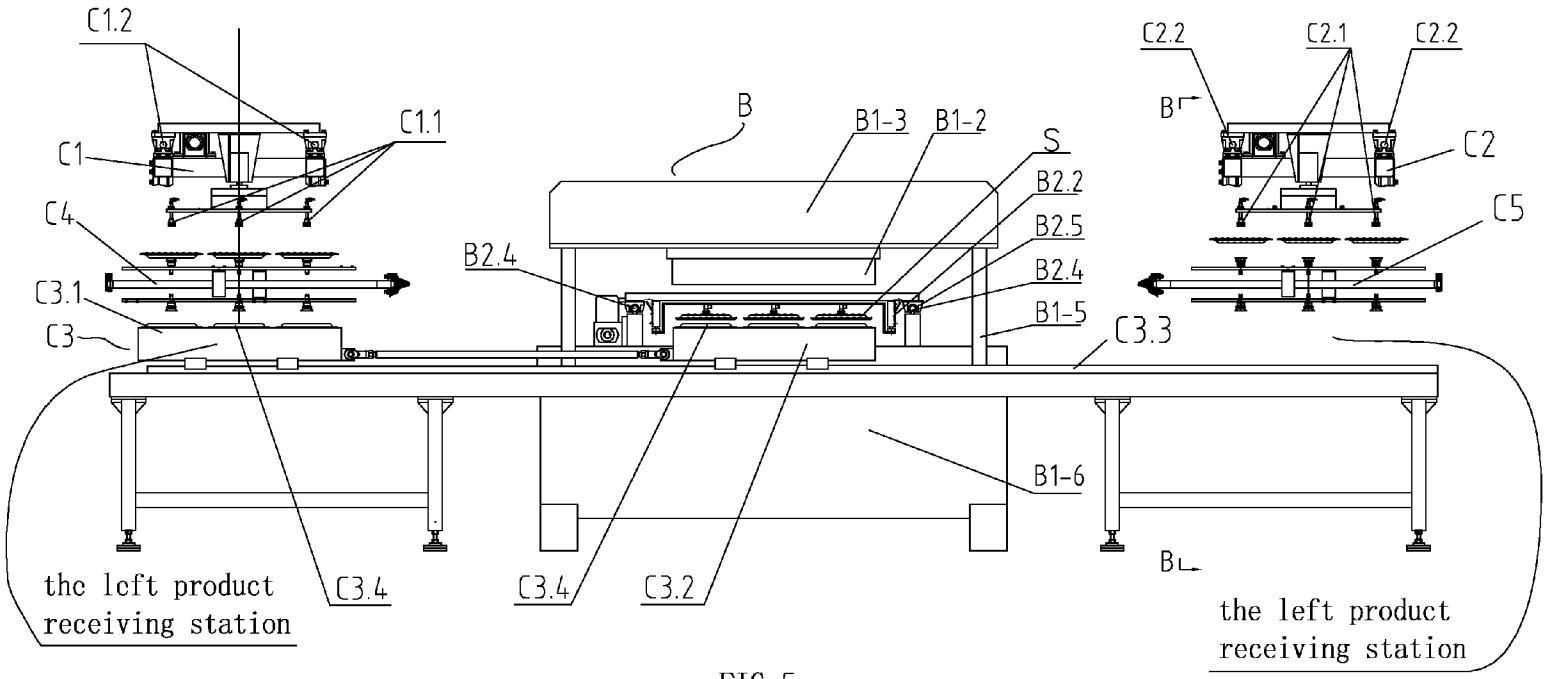
FIG. 5 shows the schematic view of the front structure of the full-automatic plant-fiber molding, mold solidifying and margin trimming machine after the forming and solidifying device is removed.
Figure 5:
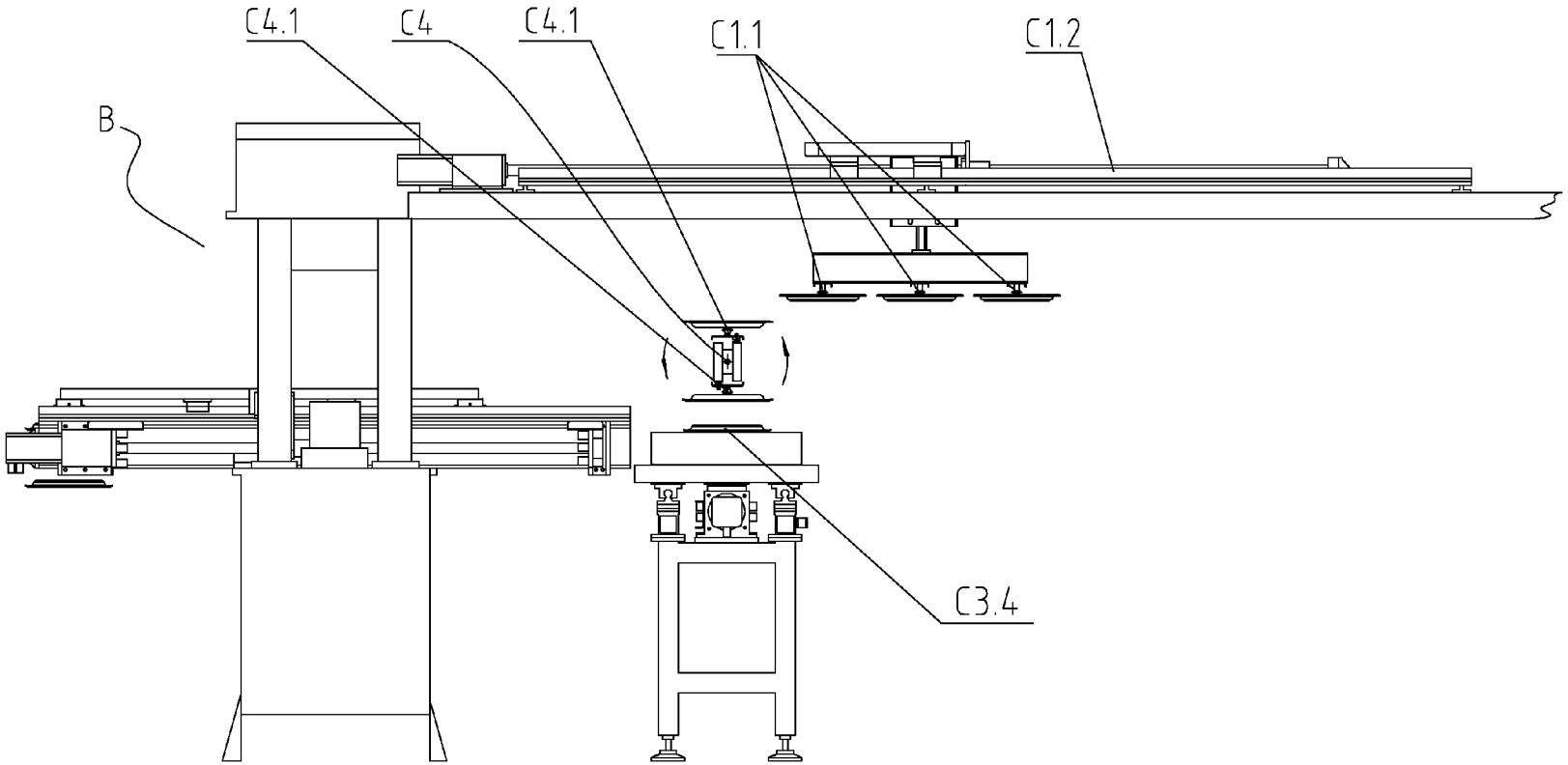
Figure 5:
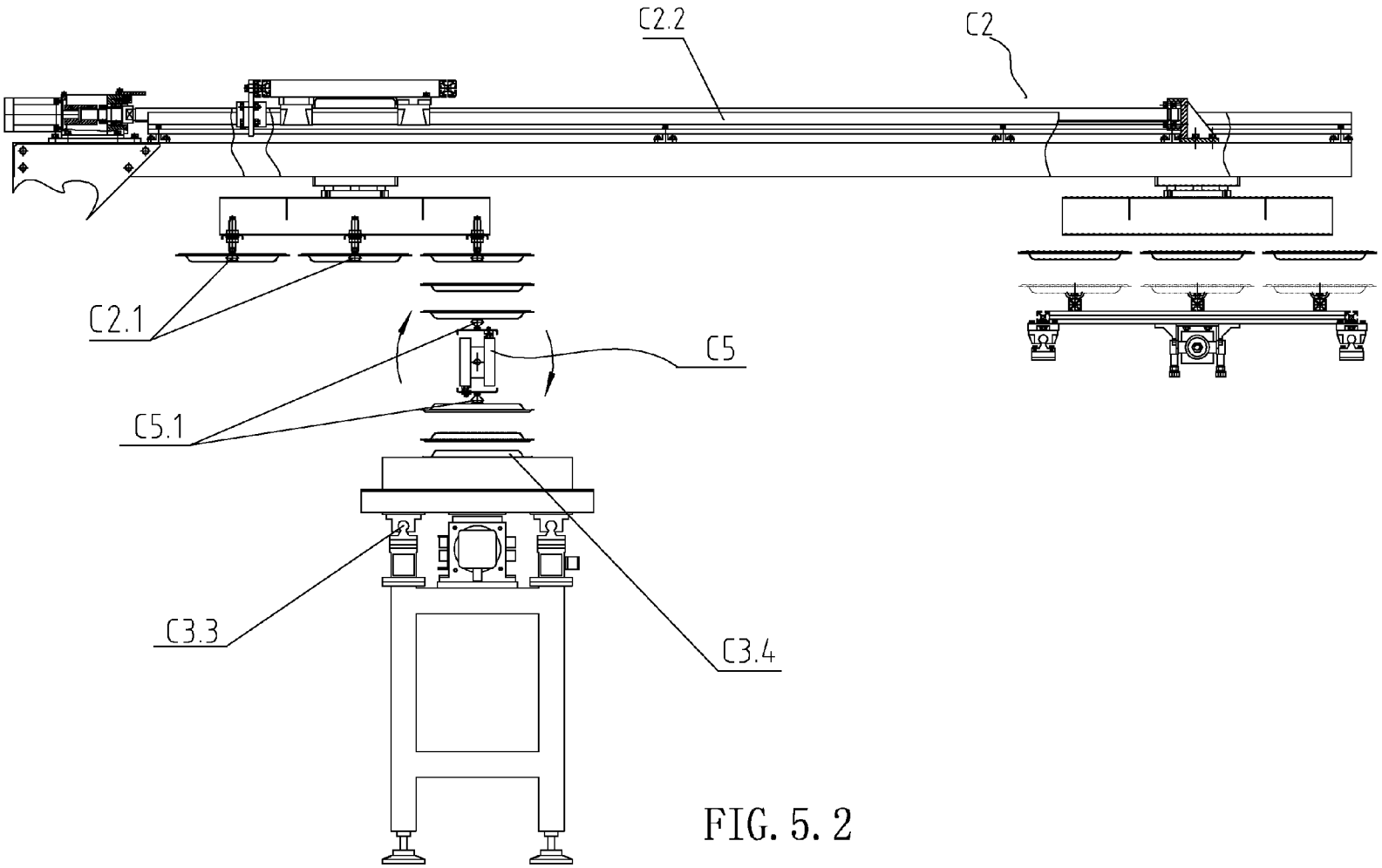

As shown in FIGS. 2 and 3, the margin trimming device is located at the rear side of the suck-filter forming device. The left positioning collection device and the right positioning collection device are symmetrically arranged on the left and right sides of the forming and solidifying device. To deliver the products regularly arranged in the left and right positioning collection devices to the position to be margin trimmed of the margin trimming device, such process requires being completed by the transfer device symmetrically arranged; the specific process is: the products symmetrically arranged on the left and right sides of the forming and solidifying device in the left and right positioning collection trays are delivered to the position to be margin trimmed of the margin trimming device at the rear side of the suck-filter forming device (namely: the products in the left positioning collection tray shall be transferred to the left product receiving station and moved to the right to the position to be margin trimmed of the margin trimming device; the products in the right positioning collection tray shall be transferred to the right product receiving station and moved to the left to the position to be margin trimmed of the margin trimming device). As shown in FIGS. 2, 3 and 5.1, the transfer device C comprises a left discharge mechanism C1, a right discharge mechanism C2, a mechanism C3 for alternatively feeding products to be margin trimmed; if flipping is required, the transfer device C also comprises: a left storage flipper C4 and a right storage flipper C5.

The left discharge mechanism C1 has the same structure and working principle as the right discharge mechanism C2. The left discharge mechanism C1 and the right discharge mechanism C2 are arranged on the left and right sides of the full-automatic plant-fiber molding, mold solidifying and margin trimming machine respectively.

The left discharge mechanism C1 comprises a left discharge sucker kit C1.1 that can be movable up and down, a left discharge horizontal track C1.2, a left power transmission mechanism; the left discharge mechanism is responsible for absorbing products from the left positioning collection tray and moving backward; the right discharge mechanism comprises a right discharge sucker kit C2.1 that can be movable up and down, a right discharge horizontal track C2.2, a right power transmission mechanism; the right discharge mechanism is responsible for absorbing products from the right positioning collection tray and moving backward. The left discharge mechanism and the right discharge mechanism have achieved the backward transfer of the products.

The mechanism C3 for alternatively feeding products to be margin trimmed comprises a left transport vehicle C3.1, a right transport vehicle C3.2, a transport vehicle track C3.3, a power transmission mechanism of the transport vehicle (cylinder or screw mechanism driven by a motor), wherein the left transport vehicle and the right transport vehicle are mounted with a positioning tray to be margin trimmed C3.4. The left and right transport vehicles with a positioning tray to be margin trimmed are responsible for alternatively delivering the products (or the products transferred after being flipped by the left and right storage flippers) directly transferred from the left discharge sucker kit C1.1 and the right discharge sucker kit C2.1 to the position to be margin trimmed of the margin trimming device (the position to be margin trimmed is between the left product receiving station and the right product receiving station), thus achieving the left and right transfer of the products.

When the positioning tray to be margin trimmed on the left transport vehicle C3.1 receives the products transferred from the left discharge sucker kit C1.1 or the left storage flipper C4, the left transport vehicle and the positioning tray to be margin trimmed on the left transport vehicle are in the left position of the transport vehicle track C3.3, known as the left product receiving station; when the positioning tray to be margin trimmed on the right transport vehicle C3.2 receives the products transferred from the right discharge sucker kit C2.1 or the right storage flipper C5, the right transport vehicle and the positioning tray to be margin trimmed on the right transport vehicle are in the right position of the transport vehicle track, known as the right product receiving station.

The left transport vehicle with a positioning tray to be margin trimmed moves between the left product receiving station and the position to be margin trimmed of the margin trimming device along the transport vehicle track; the right transport vehicle with a positioning tray to be margin trimmed moves between the position to be margin trimmed of the margin trimming device and the right product receiving station along the transport vehicle track.

The left discharge sucker kit C1.1 (including any component for absorbing products) absorbs products from the left positioning collection tray and transfers them backward to the left storage flipper with a flipping sucker kit in the left position of the transport vehicle track (the left product receiving station) or directly to the positioning tray to be margin trimmed in the left transport vehicle on the left product receiving station; the right discharge sucker kit (including any component for absorbing products) absorbs products from the right positioning collection tray and transfers them backward to the right storage flipper with a flipping sucker kit in the right position of the transport vehicle track (the right product receiving station) or directly to the positioning tray to be margin trimmed in the right transport vehicle on the right product receiving station.

Further, if products require being flipped 180-degrees before being placed into the margin trimming mold, so that such products shift from the convex surface facing downward to the concave surface facing downward (or the original products shift from the concave surface facing downward to the convex surface facing downward), thus realizing the shift of the convex surface and the concave surface. If a left storage flipper C4 is arranged at the intersection between the left position of the transport vehicle track C3.3 and the left discharge horizontal track C1.2 (above the left product receiving station), such flipper C4 is located in the left position of the transport vehicle track C3.3, above the left product receiving station and the transport vehicle track, and below the left discharge horizontal track; if a right storage flipper C5 is arranged at the intersection of the transport vehicle track and the right discharge horizontal track C2.2 (above the right product receiving station), such flipper C5 is located in the right position of the transport vehicle track, above the right product receiving station and the transport vehicle track, and below the right discharge horizontal track.

As shown in FIGS. 3, 5.1 and 5.2, the left discharge sucker kit moves downward to absorb the products from the left positioning collection tray and moves upward to its original position, then moves backward to transfer such products above the left storage flipper with a flipping sucker kit in the left position of the transport vehicle track (the left discharge sucker kit transfers the products to the flipping sucker kit on the left storage flipper in batch or completely); the flipping sucker kit with its opening facing upward on the left storage flipper receives the products transferred from the left discharge sucker kit, withdraws and absorbs the products transferred from the left discharge sucker kit to rotate 180-degrees around the axis directly or step by step until the opening faces downward to flip the products 180-degrees; and then the flipping sucker kit transfers the products to the positioning tray to be margin trimmed in the left transport vehicle on the left product receiving station below the left storage flipper. Similarly, the right discharge sucker kit moves downward to absorb the products from the right positioning collection tray and moves upward to its original position, then moves backward to deliver such products above the right storage flipper with a flipping sucker kit in the right position of the transport vehicle track (the right discharge sucker kit transfers the products to the flipping sucker kit on the right storage flipper in batch or completely); the flipping sucker kit with its opening facing upward on the right storage flipper receives the products transferred from the right discharge sucker kit, withdraws and absorbs the products transferred from the right discharge sucker kit to rotate 180-degrees around the axis directly or step by step until the opening faces downward to flip the products 180-degrees; and then the flipping sucker kit transfers the products to the positioning tray to be margin trimmed in the right transport vehicle on the right product receiving station below the right storage flipper.

As shown in FIGS. 3, 5.1 and 5.2, the left storage flipper C4 is usually mounted with one set or two sets of flipping sucker kits C4.1; the flipping sucker kit can rotate around the axis on the left storage flipper C4 while the two sets of flipping sucker kits C4.1 are symmetrically arranged around the axis. In special conditions, there are more than two sets of flipping sucker kits C4.1; similarly, the right storage flipper C5 is usually mounted with one set or two sets of flipping sucker kits C5.1; the flipping sucker kit can rotate around the axis on the left storage flipper C5 while the two sets of flipping sucker kits are symmetrically arranged around the axis. In special conditions, there are more than two sets of flipping sucker kits C5.1.

As shown in FIG. 5.1, the left discharge sucker kit C1.1 can move up and down, and move back and forth along the left discharge horizontal track C1.2 driven by the power transmission mechanism. The power transmission mechanism for driving the left discharge sucker kit C1.1 to move back and forth horizontally can be driven by the motor screw, or by the synchronous motor belt (or chain), or by the cylinder or other power.

As shown in FIG. 5.2, the right discharge sucker kit C2.1 can also move up and down, and move back and forth along the right discharge horizontal track C2.2 driven by the power transmission mechanism. The power transmission mechanism for driving the right discharge sucker kit C2.1 to move back and forth horizontally can be driven by the motor screw, or by the synchronous motor belt (or chain), or by the cylinder or other power.

The left discharge sucker kit C1.1, the right discharge sucker kit C2.1 and the sucker on the flipping sucker kit are connected to a negative-pressure device (such as conventional suction pump or vacuum generator or vacuum pump or any means for generating the negative pressure) respectively by means of a pipe mounted with a control valve, wherein the full-automatic plant-fiber molding, mold solidifying and margin trimming machine is mounted with a control switch for opening and closing the control valve so that the sucker is connected to the negative pressure device to generate the negative pressure and suction force during product suction, or the front-row or back-row margin trimming sucker kit or the flipping sucker kit is disconnected from the negative pressure device during product placement so as to relieve the negative pressure of the corresponding sucker kits and allow the corresponding sucker kits to place such products.

The left discharge sucker kit C1.1 can move back and forth along the left discharge horizontal track C1.2, move above the left positioning collection tray and the left storage flipper C4, and absorb the products on the left positioning collection tray A5.1 to deliver them above the left storage flipper C4. The left discharge sucker kit C1.1 transfers the products to the flipping sucker kit on the left storage flipper C4 step by step or in batch with the opening facing upward. As shown in FIG. 5.1, the flipping sucker kit absorbs the products transferred from the left discharge sucker kit C1.1 and rotates 180-degrees around the axis directly or step by step under the action of the rotating cylinder or other mechanisms until the opening of the flipping sucker kit faces downward to flip the products 180-degrees and transfer the products to the positioning tray to be margin trimmed in the left transport vehicle C3.1 waiting below the left storage flipper C4. During transfer, the flipping sucker kit relieves the negative pressure to make the products fall onto the positioning tray to be margin trimmed in the left transport vehicle C3.1 for correction rectifying and positioning. The positioning tray to be margin trimmed with the products moves to the right with the left transport vehicle C3.1 and reaches the position to be margin trimmed of the margin trimming device so as to deliver such products to the position to be margin trimmed of the margin trimming device accurately. Subsequently, the products are delivered to the margin trimming device for margin trimming.

Similarly, the right discharge sucker kit C2.1 can move back and forth along the right discharge horizontal track C2.2, move above the right positioning collection tray and the right storage flipper C5, and absorb the products on the right positioning collection tray A6.1 to deliver them above the right storage flipper. The right discharge sucker kit transfers the products to the flipping sucker kit on the right storage flipper step by step or in batch with the opening facing upward. As shown in FIG. 5.2, the flipping sucker kit absorbs the products transferred from the right discharge sucker kit and rotates 180-degrees around the axis directly or step by step under the action of the rotating cylinder or other mechanisms until the opening of the flipping sucker kit faces downward to flip the products 180-degrees and transfer the products to the positioning tray to be margin trimmed in the right transport vehicle C3.2 waiting below the right storage flipper. During transfer of products, the flipping sucker kit relieves the negative pressure to make the products fall onto the positioning tray to be margin trimmed in the right transport vehicle from the flipping sucker kit with the opening facing downward for correction rectifying and positioning. The positioning tray to be margin trimmed with the products moves to the left with the right transport vehicle and reaches the position to be margin trimmed of the margin trimming device so as to deliver such products to the position to be margin trimmed of the margin trimming device accurately. Subsequently, the products are delivered to the margin trimming device for margin trimming.

Thus, such products are alternatively delivered to the position to be margin trimmed of the margin trimming device.

The left transport vehicle C3.1 and the right transport vehicle C3.2 can be connected together at a distance, wherein such vehicles can move to the left and right simultaneously along the transport vehicle track or stop at a specific position. The left transport vehicle moves between the left product receiving station and the position to be margin trimmed of the margin trimming device while the right transport vehicle moves between the right product receiving station and the position to be margin trimmed of the margin trimming device. The left and right transport vehicles alternatively reach the position to be margin trimmed of the margin trimming device. When the left transport vehicle moves to the left to reach the left product receiving station below the flipping sucker kit of the left storage flipper C4, the left and right transport vehicles all stop moving, wherein the positioning tray to be margin trimmed on the left transport vehicle receives the products transferred from the left storage flipper C4, the right transport vehicle is in the position to be margin trimmed. When the positioning tray to be margin trimmed on the left transport vehicle moves to the right to reach the position to be margin trimmed of the margin trimming device with the products transferred from the left storage flipper, the positioning tray to be margin trimmed on the right transport vehicle moves to the right to reach the position below the right storage flipper C5. When the margin trimming device absorbs the products away from the left transport vehicle to the margin trimming position, the right transport vehicle receives the products transferred from the right storage flipper. When the left transport vehicle moves to the left again to reach the left product receiving station below the left storage flipper, the right transport vehicle moves to the left again to reach the position to be margin trimmed of the margin trimming device with the products transferred from the right storage flipper, wherein the margin trimming device absorbs the products away from the right transport vehicle to the margin trimming position, the left transport vehicle receives the products transferred from the left storage flipper C4 again.

In this way, the positioning trays to be margin trimmed on the left and right transport vehicles alternatively deliver the products to the position to be margin trimmed of the margin trimming device from the left and right storage flippers; namely, the products on the left and right positioning collection trays are alternatively delivered to the position to be margin trimmed of the margin trimming finally. Meanwhile, the positioning trays to be margin trimmed on the left and right transport vehicles are product locators to be margin trimmed in the position to be margin trimmed of the margin trimming device, wherein such trays alternatively reach and stop in the position to be margin trimmed.

The positioning tray to be margin trimmed is fixedly mounted on the transport vehicle. The positioning tray to be margin trimmed can be non-metallic (such as plastic trays) or metallic trays for guiding and positioning with the shape completely or partially matching with the products, or metallic or non-metallic molds with the shape matching with the products, or cavity plates allowing products partially into the cavities, limiting rings, limiting rods, limiting utensils, limiting devices and metallic or non-metallic plate assemblies for limiting the rim of the products (or for limiting) or other devices for guiding and positioning of the products.

For some products without flipping, the left and right storage flippers are not required; the left discharge sucker kit absorbs the products directly from the left positioning collection tray to the positioning collection tray in the left transport vehicle on the left product receiving station; the right discharge sucker kit absorbs the products directly from the right positioning collection tray to the positioning collection tray in the right transport vehicle on the right product receiving station. Similarly, the positioning trays on the left and right transport vehicles deliver the products transferred from the left and right discharge sucker kits to the position to be margin trimmed of the margin trimming device.

The purpose of configuring the storage flipper is: to flip the products before products are placed into the margin trimming device. The reason is that the forming and solidifying process and the margin trimming process have different requirements for the orientation of the convex and concave product surface. For example, when the concave surface of the product mold faces upward in the forming and solidifying device, the concave surface of the products in the left and right positioning collection trays positioned and regularly arranged also faces upward. However, the products shall be provided with a convex surface upward in the margin trimming device for margin trimming. At this time, the concave and convex surface of the product requires being changed before it moves to the position to be margin trimmed of the margin trimming device. Moreover, when the margin trimming device is required for margin trimming of the products transferred from the left or right discharge sucker kit in batch, the left or right transport vehicle is needed to deliver the products transferred from the left or right discharge sucker kit in batch for many times. At this time, the left or right discharge sucker kit requires waiting to be transferred in batch. To reduce the waiting time of the left or right discharge sucker kit, a storage flipper is required; one set or two sets or three sets of flipping sucker kits can be arranged in the circumferential direction of the left or right storage flipper. Each set of flipping sucker kits receive a corresponding set of products from the left or right discharge sucker kit and transfer them onto the positioning tray to be margin trimmed of the left or right transport vehicles orderly step by step or in batch. After the left or right discharge sucker kit delivers the products to the left or right storage flipper, it can return above the left or right positioning collection tray in advance for transfer of the next products.

Therefore, the left or right storage flipper is configured depending on the product structure and the specific process.

The margin trimming device B is arranged on the rear side of the forming and solidifying device (as shown in FIG. 2). After the products are delivered to the position to be margin trimmed of the margin trimming device, a margin trimming device B is used to transfer the products to be margin trimmed to the margin trimming position from the position to be margin trimmed for margin trimming, and then deliver the margin trimmed products to the completion position away from the margin trimming position. The margin trimming device B transfers the products from the position to be margin trimmed, margin trimming position to the completion position progressively, thus completing the margin trimming process. Therefore, the full-automatic production process is accomplished completely from wet semifinished products forming, hot press mold solidifying to automatic margin trimming.

Figures 1, 6:
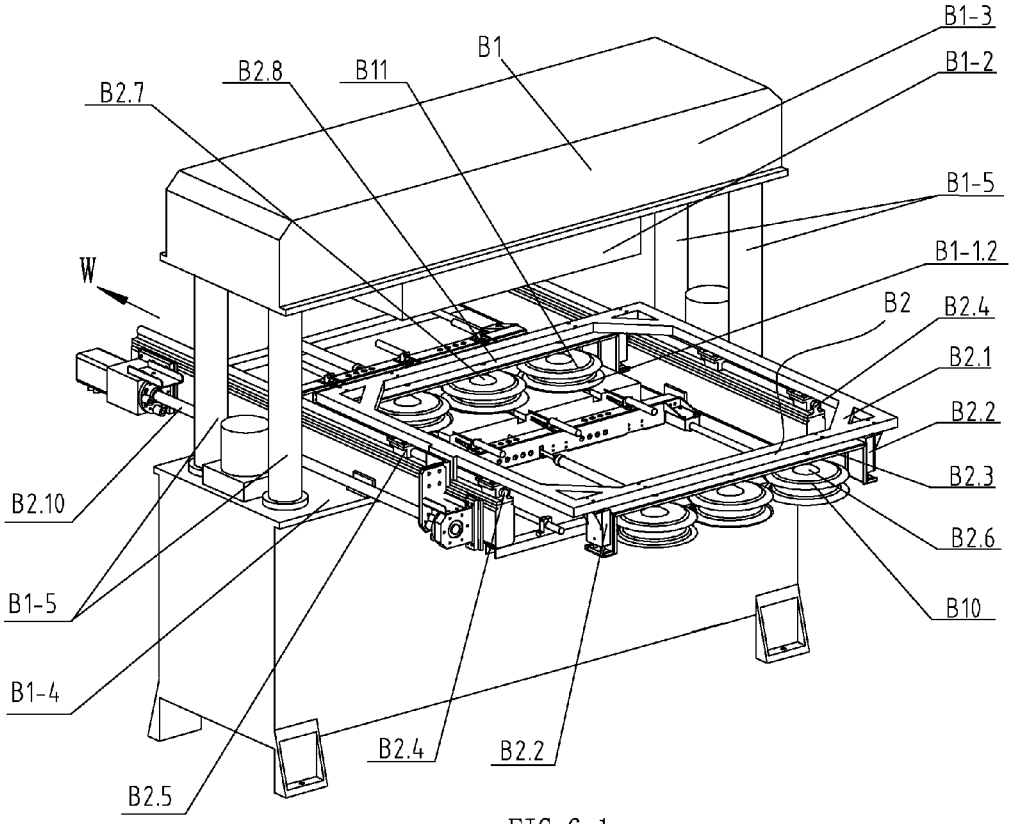
Figures 2, 6:
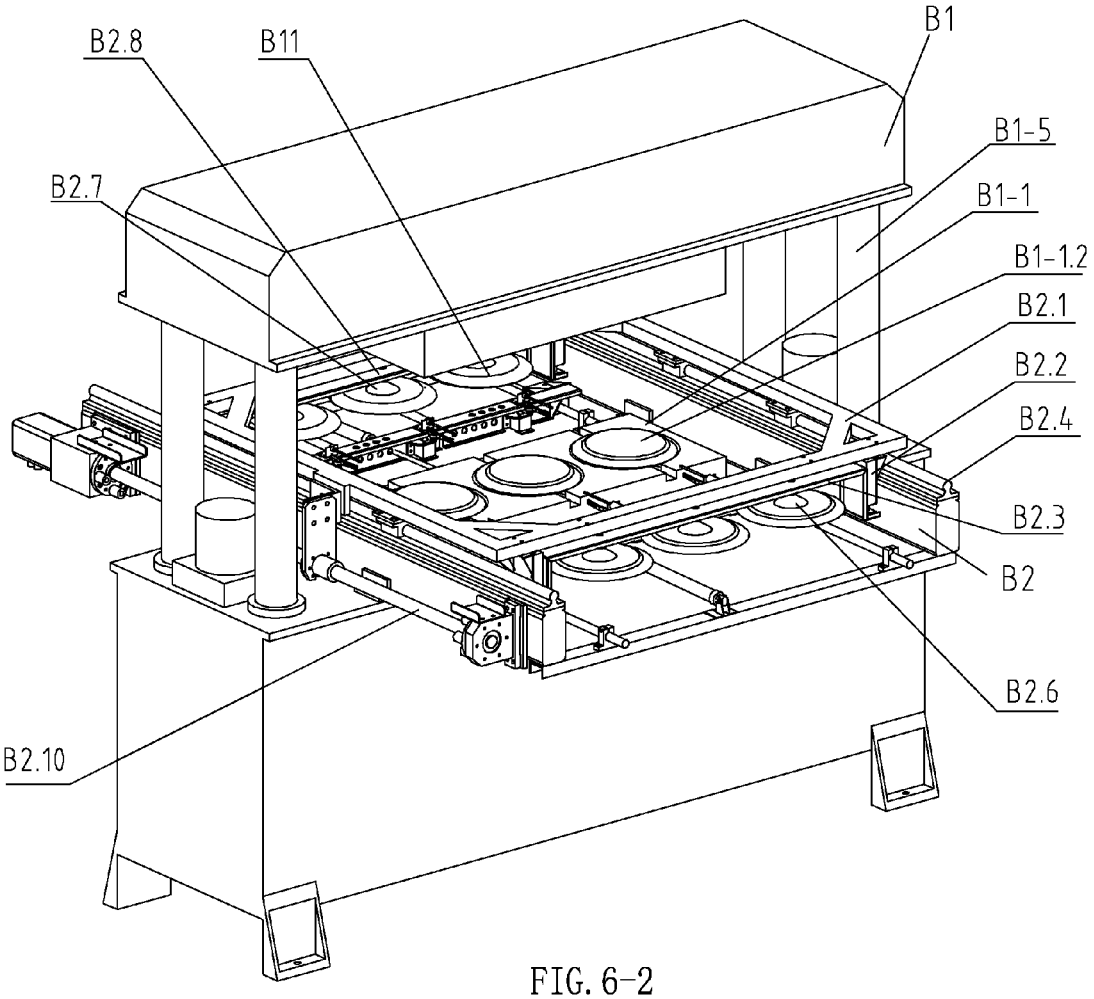
Figures 3, 6:
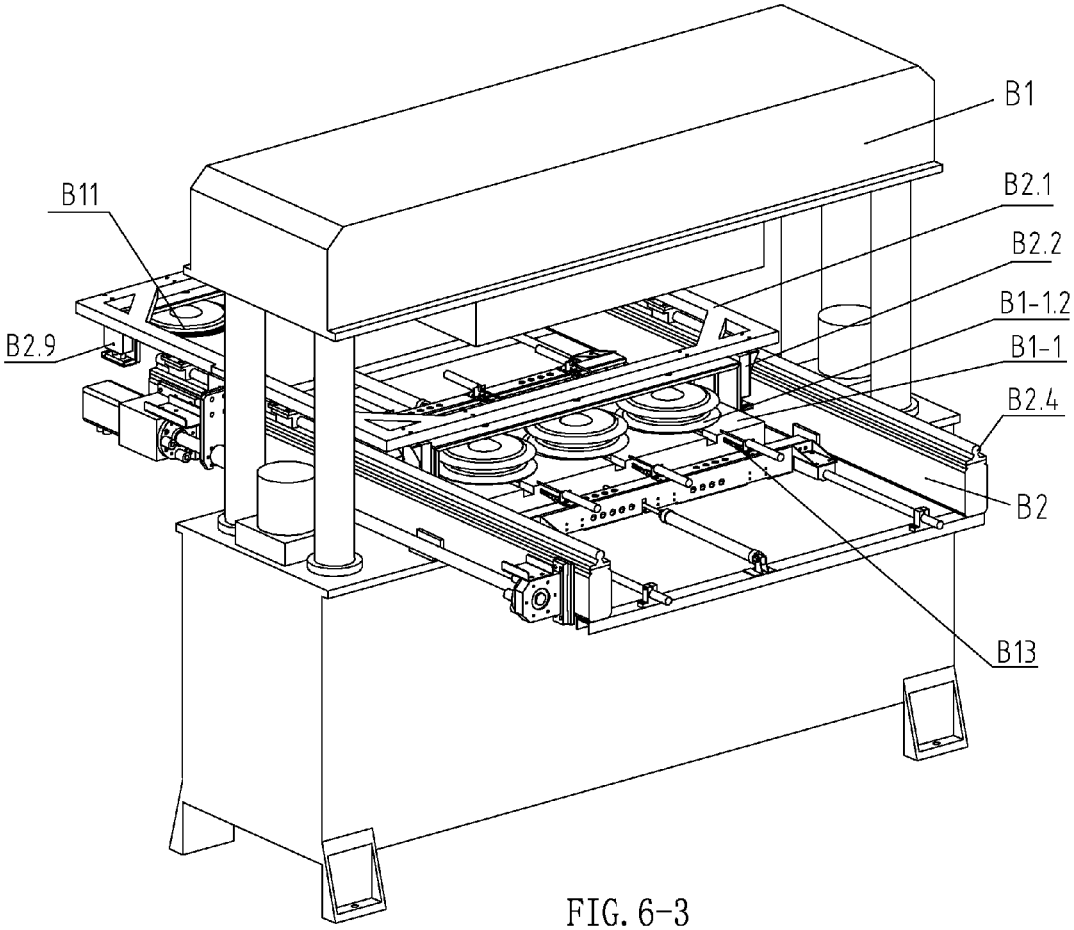
Figures 1, 7:
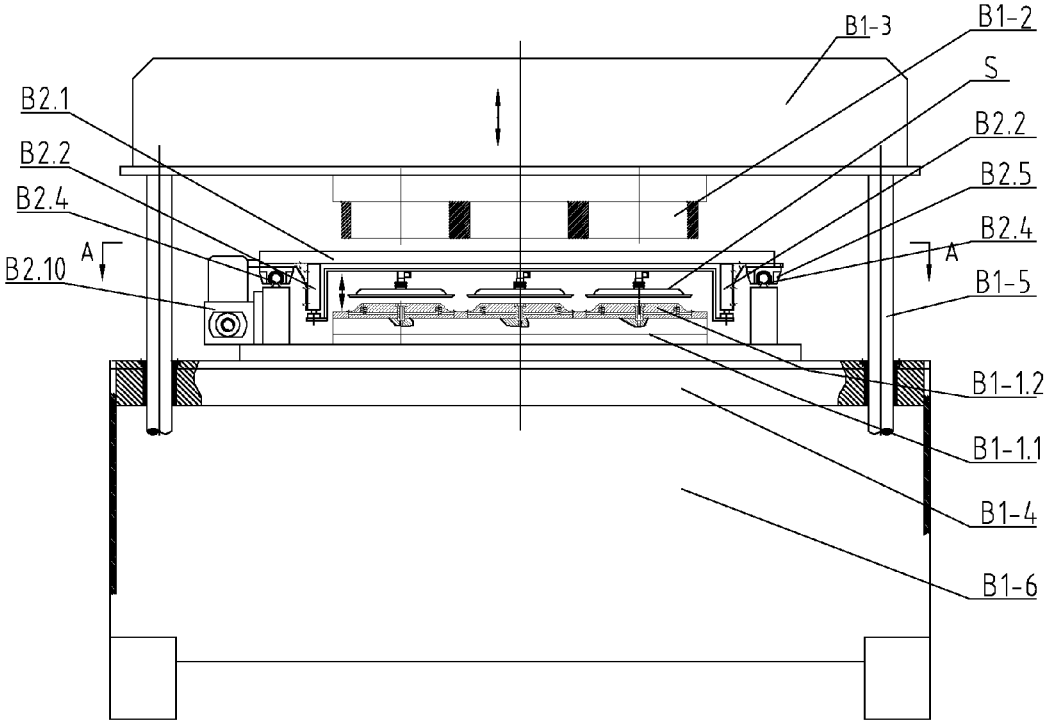
Figures 2, 7:
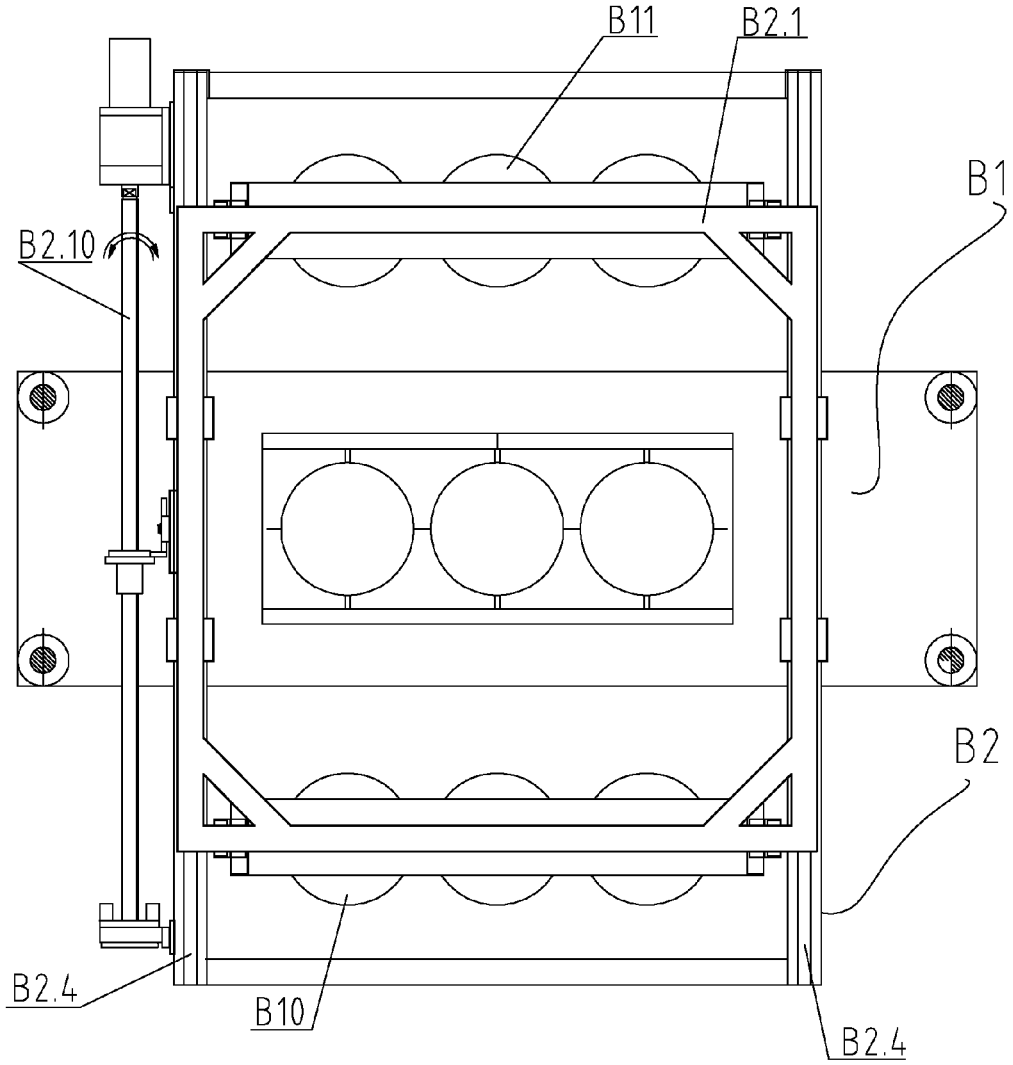
Figures 3, 7:
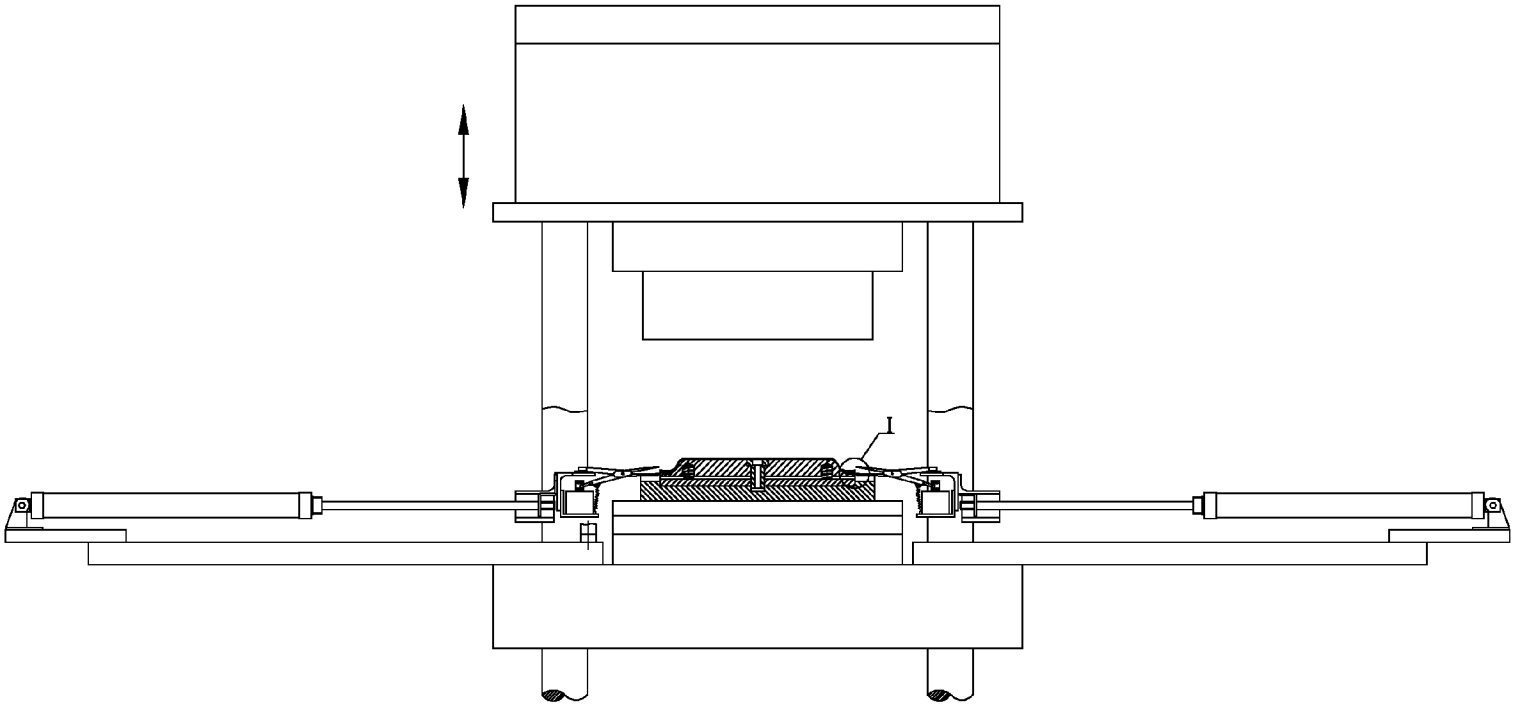
Figures 4, 7:
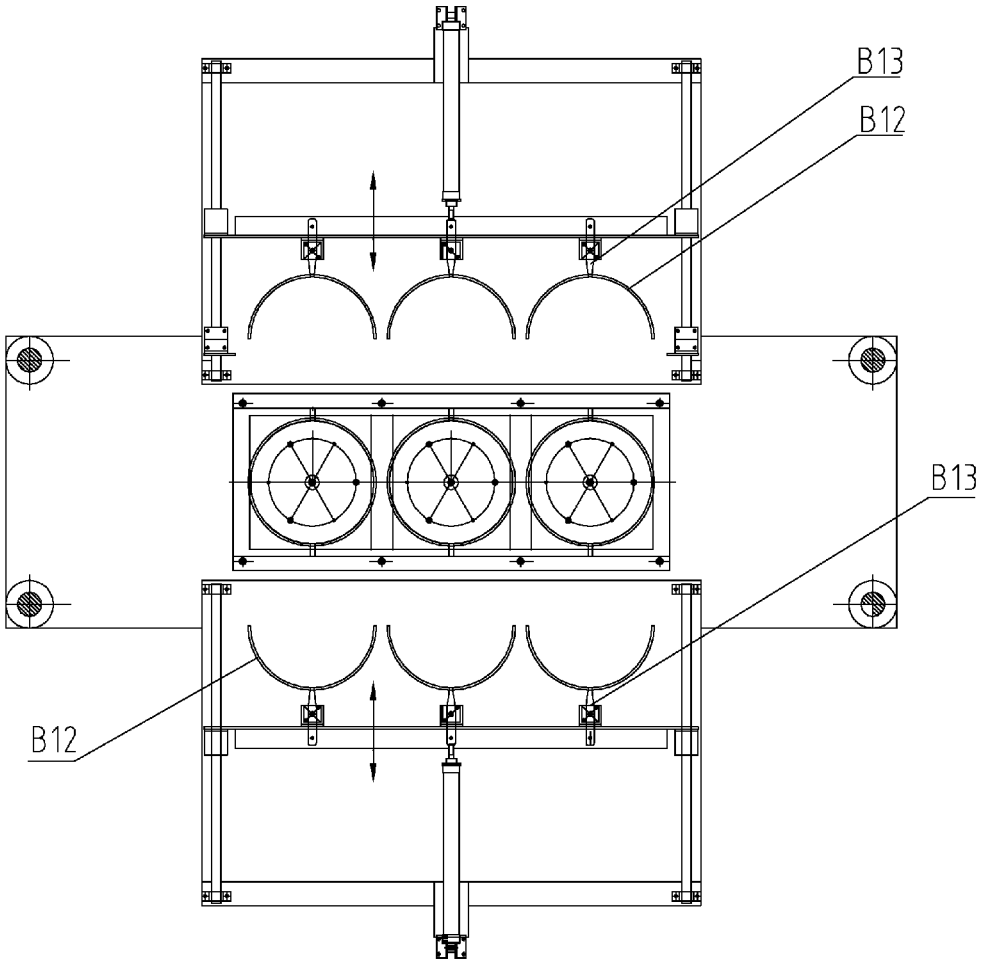
Figures 5, 7:
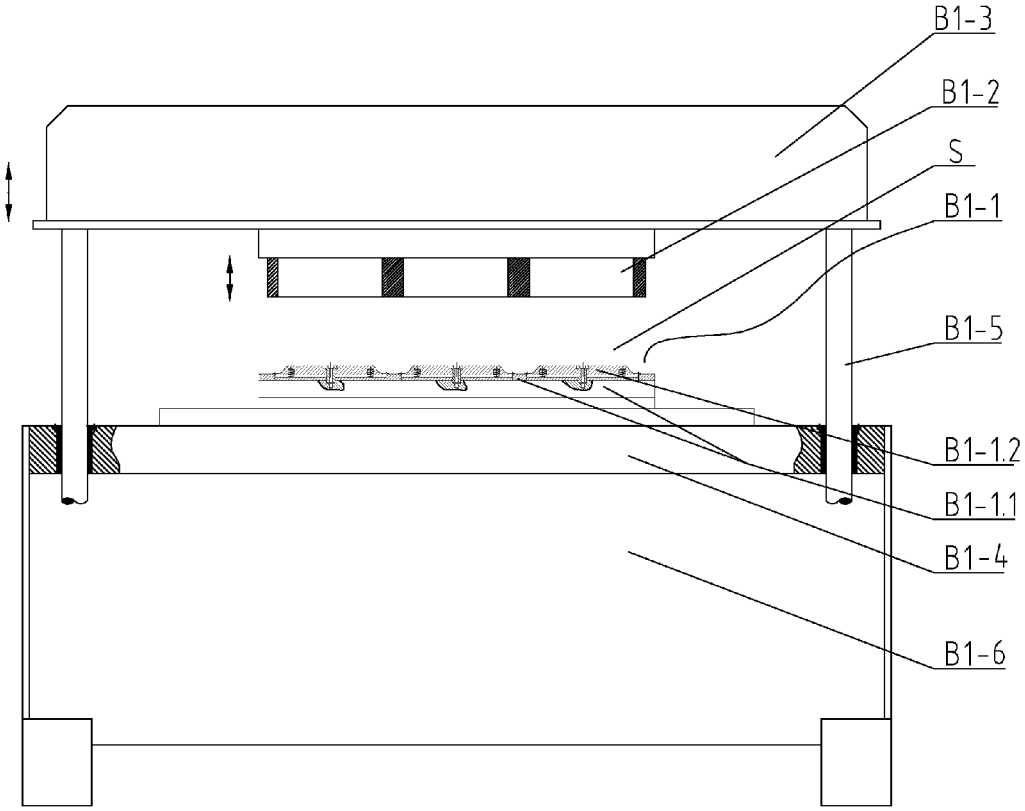
Figures 5, 7:
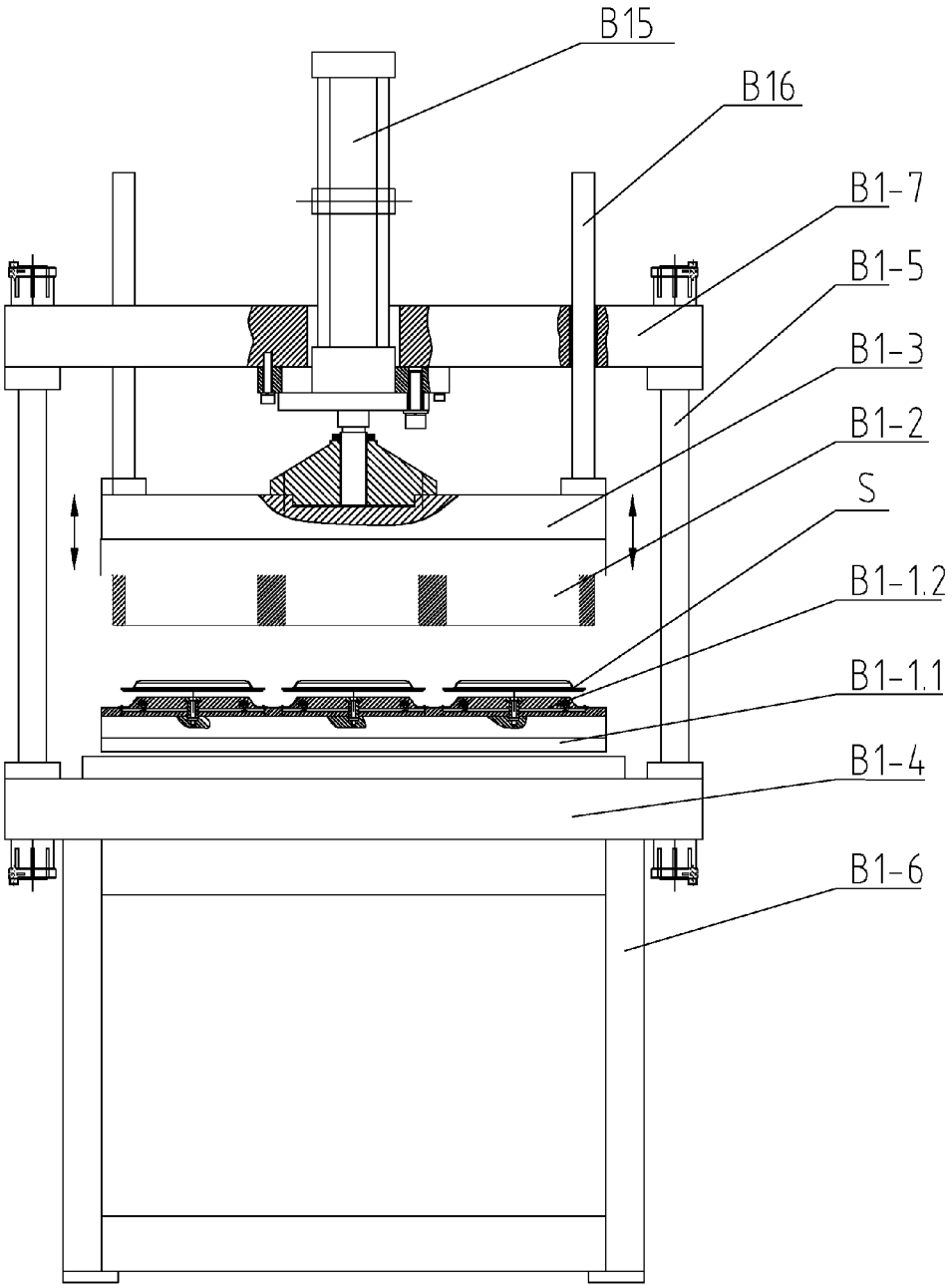
Figures 5, 7:
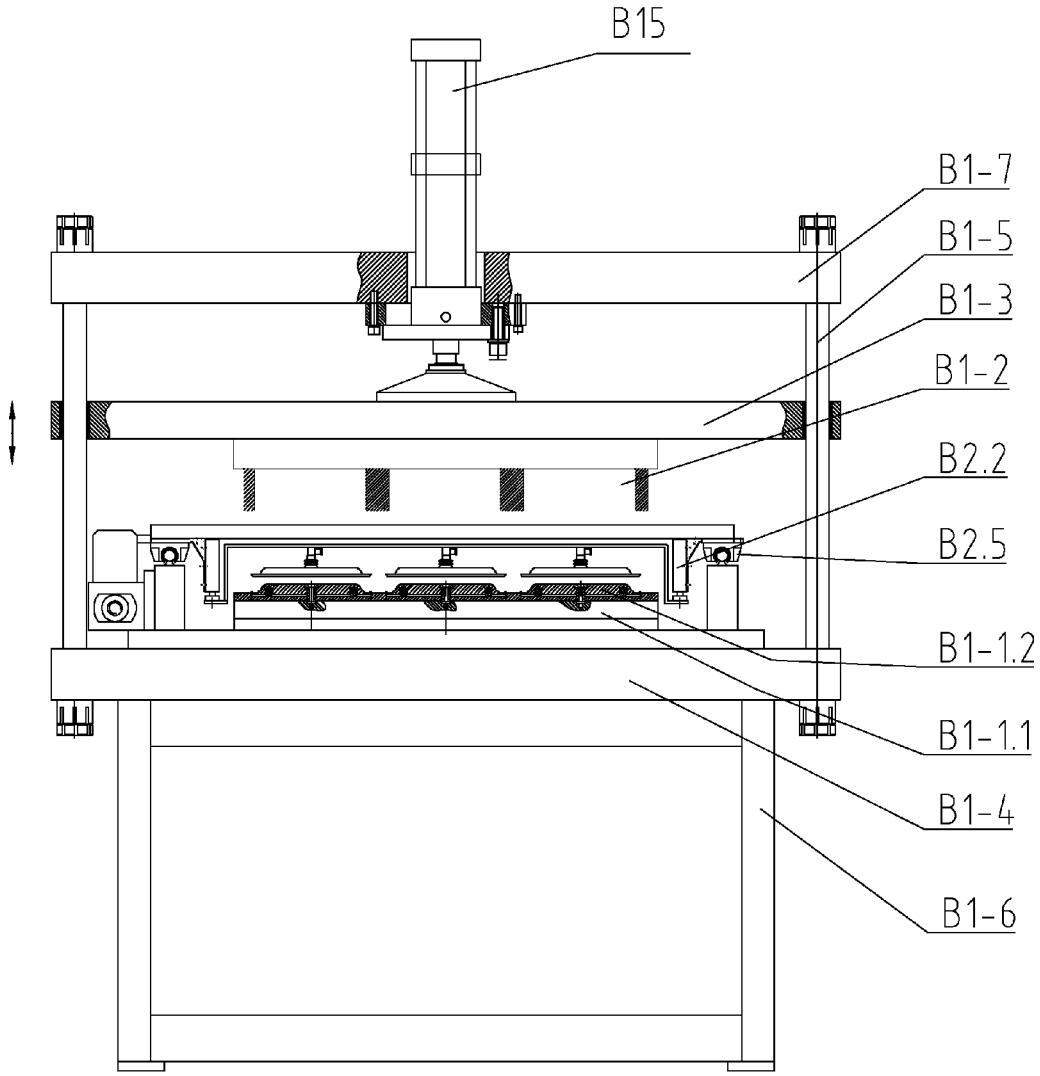
Figure 6:
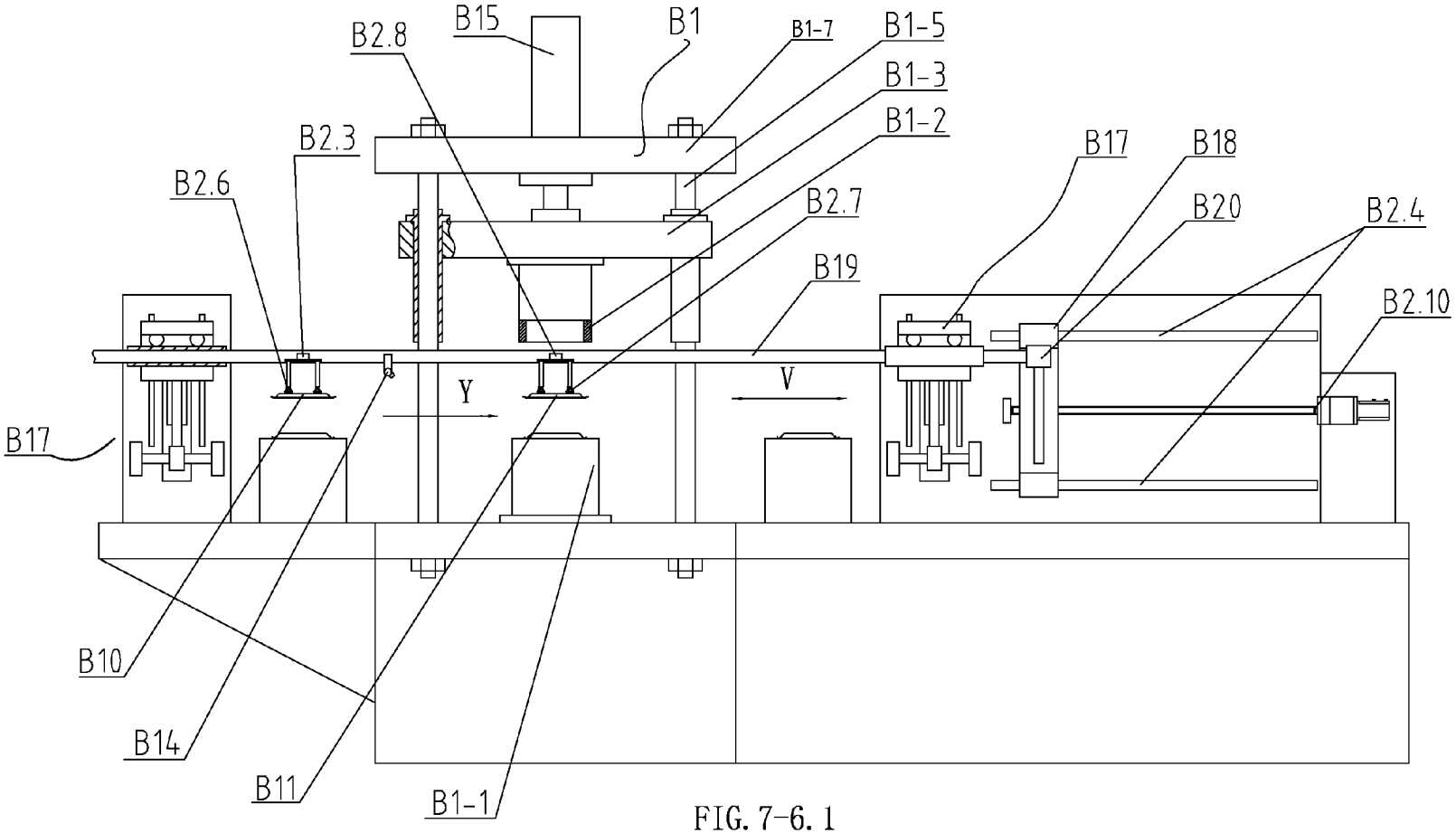
Figures 6, 7:
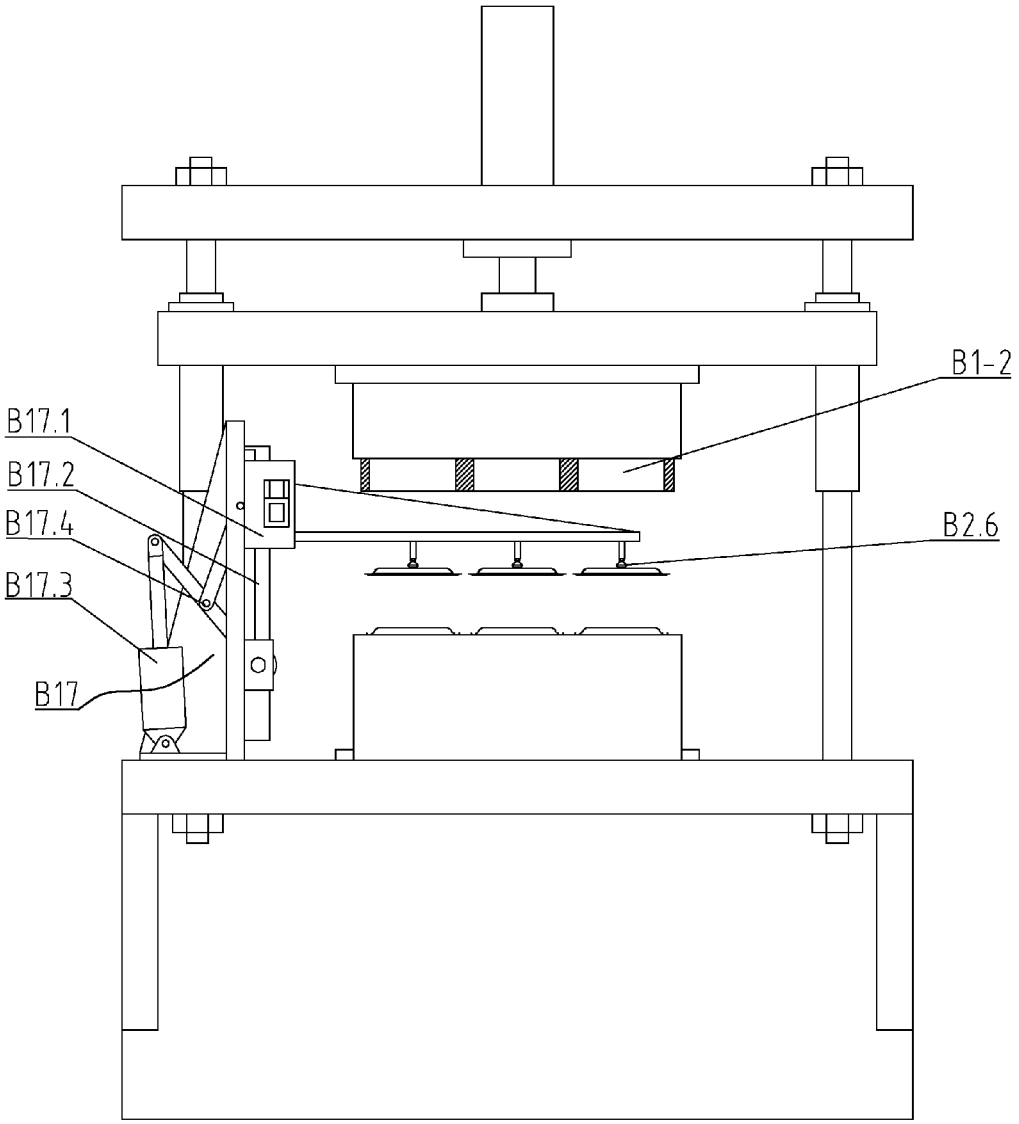
Figures 6, 7:
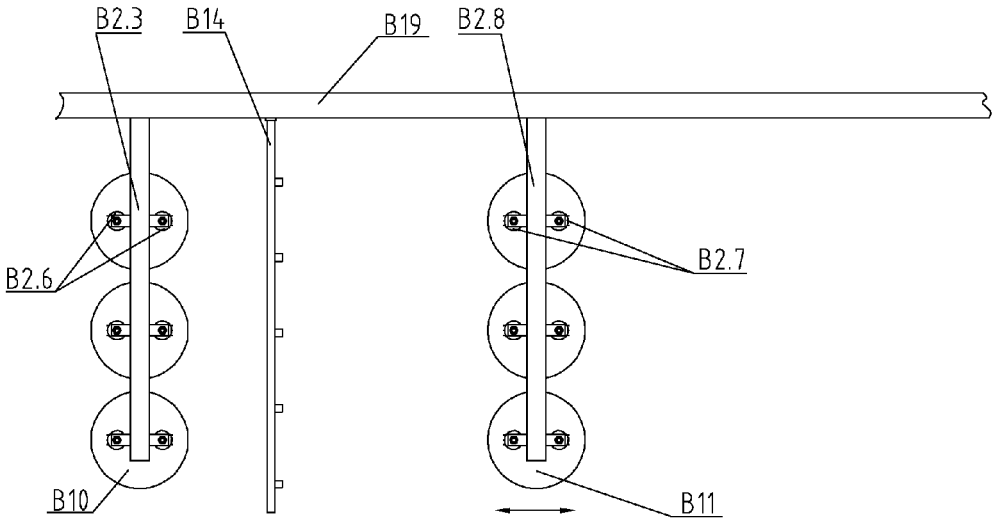
Figures 6, 7:
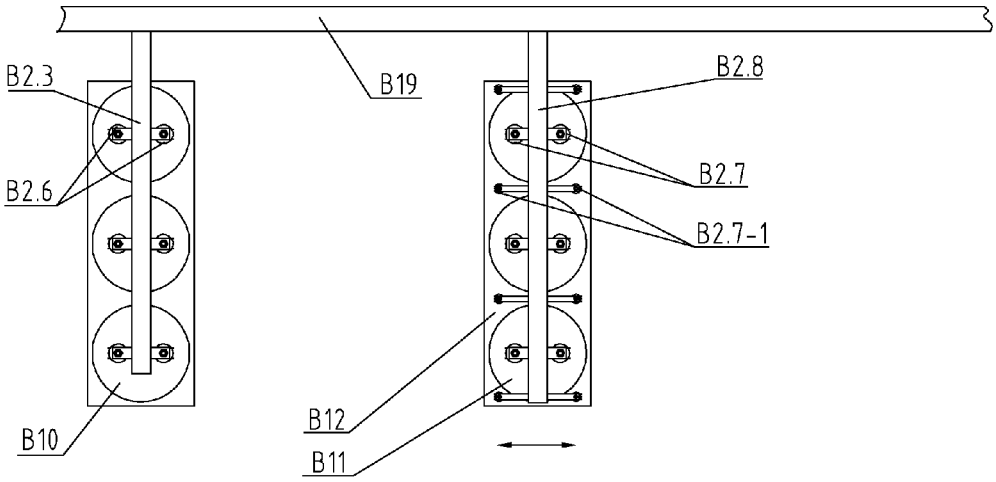
Figure 7:
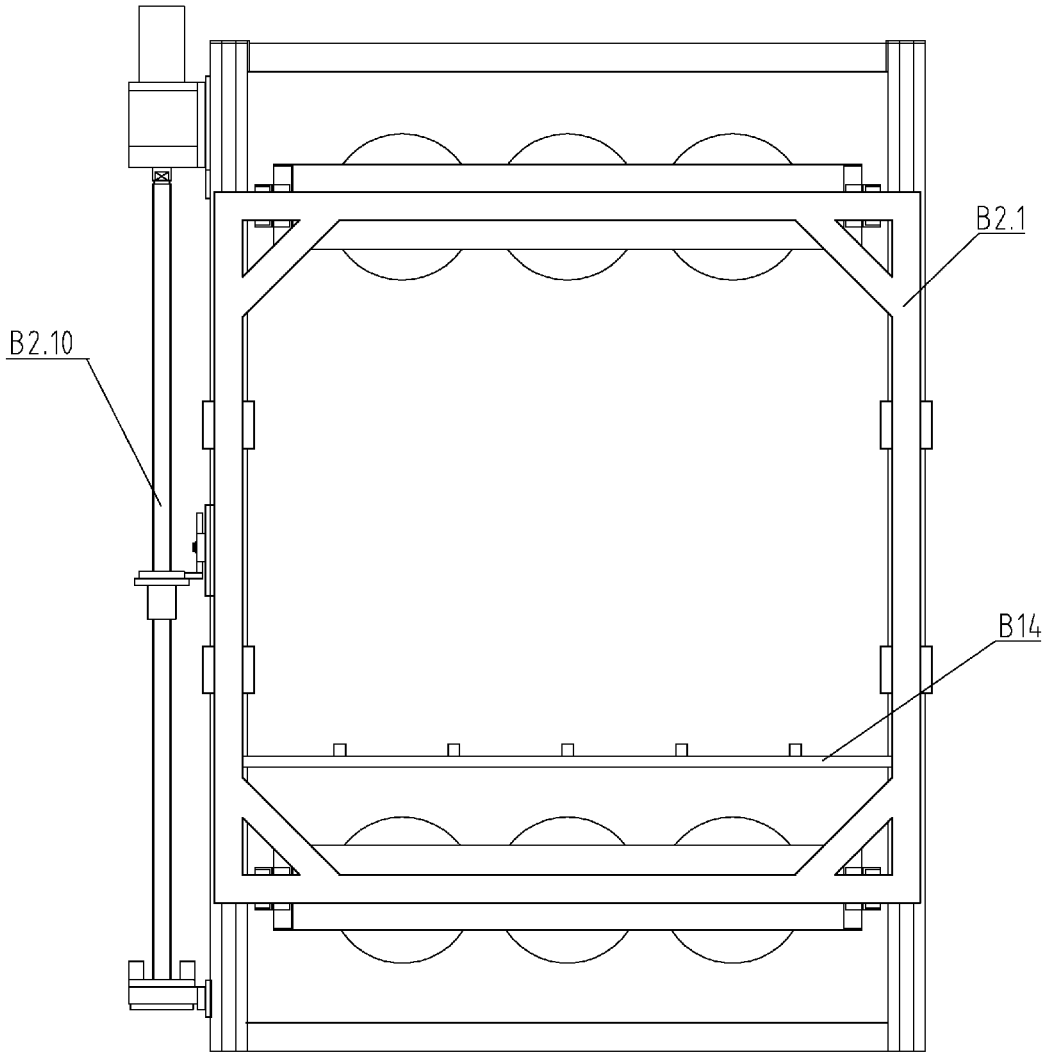

As shown in FIGS. 6-1, 6-2, 6-3, 7-1, 7-2 and 7-3, the margin trimming device B comprises: a margin trimming and clamping mechanism and a product transfer mechanism. The margin trimming and clamping mechanism mainly comprises a mounting plate B1-3 of the margin trimming top mold, a mounting plate B1-4 of the margin trimming low mold, a margin trimming mold and a clamping power mechanism (the margin trimming and clamping mechanism can be a mechanism with a mounting plate of the margin trimming top mold and a mounting plate of the margin trimming low mold, wherein such mechanism can be driven in any way to make relative movement). The clamping power mechanism drives the mounting plate of the margin trimming top mold to move relative to the mounting plate of the margin trimming low mold. The clamping power mechanism can be in many forms, such as: three-plate margin trimming and clamping mechanism (as shown in FIGS. 7-5.2 and 7-5.3) and two-plate margin trimming and clamping mechanism (as shown in FIGS. 7-5.1). The two-plate margin trimming and clamping mechanism comprises: a mounting plate of the margin trimming top mold, a mounting plate of the margin trimming low mold, a clamping rod, a margin trimming mold, a clamping power mechanism for driving (including direct or indirect drive) the mounting plate of the margin trimming top mold to move relative to the mounting plate of the margin trimming low mold, and a rack. The mounting plate of the margin trimming low mold is fixed on the rack or integrated with the rack while the mounting plate of the margin trimming top mold is fixedly connected with the clamping rod and the clamping power mechanism drives the clamping rod directly or indirectly, thus driving the mounting plate of the margin trimming top mold to move up and down relative to the mounting plate of the margin trimming low mold. The clamping rod can be in two or four pieces. The clamping power mechanism can be driven in many ways, such as tank-driven, motor-driven, cylinder-driven or liquid pressurized cylinder-driven. Despite any way, the clamping power mechanism drives the mounting plate of the margin trimming top mold to move up and down relative to the mounting plate of the margin trimming low mold through the clamping rod, and generate the clamping force during margin trimming. The three-plate margin trimming and clamping mechanism comprises: a fixed mold clamp B1-7, a mounting plate of the margin trimming top mold, a mounting plate of the margin trimming low mold, a clamping rod, a margin trimming mold, a clamping power mechanism for driving (including direct or indirect drive) the mounting plate of the margin trimming top mold to move relative to the mounting plate of the margin trimming low mold, and a rack. Compared with the two-plate margin trimming and clamping mechanism, it also includes a "fixed mold clamp". The fixed mold clamp is fixed together with the mounting plate of the margin trimming low mold which is fixed on the rack or integrated with the rack; the mounting plate of the margin trimming top mold moves relative to the mounting plate of the margin trimming low mold directly or indirectly driven by the tank B15 or cylinder or liquid pressurized cylinder; generally, the tank or cylinder or liquid pressurized cylinder is fixed on the fixed mold clamp. Besides, the mounting plate of the margin trimming top mold can also be driven by a motor, wherein embodiments of two typical three-plate margin trimming and clamping mechanisms are as shown in FIGS. 7-5.2 and 7-5.3. Despite two-plate margin trimming and clamping mechanism or three-plate margin trimming and clamping mechanism or margin trimming and clamping mechanisms in other forms, the mounting plate of the margin trimming top mold will move relative to the mounting plate of the margin trimming low mold.

As shown in FIGS. 7-5.1, 7-5.2 and 7-5.3, the margin trimming mold includes a margin trimming top mold and a margin trimming low mold, wherein the margin trimming top mold is mounted on the lower surface of the mounting plate of such mold, the margin trimming low mold is mounted on the upper surface of the mounting plate of such mold, the products can be margin trimmed into shapes or profiles of the required edge during margin trimming. A positioning block is arranged on the margin trimming low mold for determining the product position on the margin trimming low mold, wherein the partial or overall shape of the positioning block matches with the products for positioning, so that the products can be margin trimmed into shapes or profiles of the required edge accurately.

The margin trimming top and low molds will close and open respectively when closing and separating, wherein the mounting plate of the margin trimming top mold moves relative to the mounting plate of the margin trimming low mold (the movement direction as shown by arrows in FIGS. 7-1, 7-5.1, 7-5.2, 7-5.3 and 7-3) driven by the clamping power mechanism (any mechanical structure driven by such power as cylinder, tank, liquid pressurized cylinder or motor), making the margin trimming top and low molds implement the opening and clamping movements. Under the action of certain clamping force, the margin trimming top mold will close with the margin trimming low mold, trim or cut plant fiber (including the pulp) molding products or other products arranged between them. After margin trimming, the margin trimming mold will open while the margin trimmed products leave in the margin trimming low mold.

The products to be margin trimmed which have arrived to the position to be margin trimmed in advance are transferred onto the margin trimming low mold under the state of mold opening, and positioned on the positioning block of the low mold. After margin trimming, the margin trimming mold will open while the margin trimmed products are delivered out to certain position on the rear side of the margin trimming mold from the margin trimming low mold, wherein the position is known as the completion position for the products proceeding to the next process. The position for mounting the margin trimming mold and margin trimming is known as the margin trimming position. The products are transferred from the position to be margin trimmed, margin trimming position to the completion position progressively.

The margin trimming mold of the margin trimming and clamping mechanism is located in the margin trimming position of the margin trimming device B. It is explained by taking the two-plate margin trimming and clamping mechanism as an example. As shown in FIGS. 6-1, 6-2, 6-3, 7-1 and 7-2, the margin trimming and clamping mechanism of the margin trimming device B is mounted with a product deliver mechanism for transferring the products from the position to be margin trimmed, margin trimming position to the completion position progressively. The products are transferred by a margin trimming sucker kit. The margin trimming sucker kit comprises one or more separate sucker kits, wherein the sucker kit can withdraw and absorb one or more products (each sucker kit can withdraw and absorb 3 products each time in the accompanying embodiment), one or more suckers can be used for withdrawing and absorbing the same product. The margin trimming sucker kit includes the front-row margin trimming sucker kit B2.6 and the back-row margin trimming sucker kit B2.7, wherein the front-row margin trimming sucker kit absorbs the products to be margin trimmed to the margin trimming low mold in the margin trimming position from the position to be margin trimmed while the back-row margin trimming sucker kit absorbs the margin trimmed products to the completion position out of the margin trimming low mold from the positioning block of the margin trimming low mold. The product transfer mechanism is mainly responsible for transferring products.

As shown in FIGS. 6-1, 7-1, 7-5.4 and 7-7, the product transfer mechanism comprises a spaced front-row margin trimming sucker kit B2.6 and a back-row margin trimming sucker kit B2.7, a transfer track B2.4, a transport rack B2.1, a slider B2.5, a front suction cylinder B2.2, a back suction cylinder B2.9, a front sucker fixing plate B2.3, a back sucker fixing plate B2.8 and a horizontal driving device B2.10.

The front-row and back-row margin trimming sucker kits are fixed onto the front and back sucker fixing plates respectively with their openings facing downward. The front sucker fixing plate is mounted at the front end of the transport rack by the front suction cylinder. Bodies (or piston rods) of two front suction cylinders are fixed on the left and right sides at the front end of the transport rack, wherein they are connected to both ends of the front sucker fixing plate. A method can also be adopted, wherein the front sucker fixing plate can be driven by the front suction cylinder mounted at the front end of the transport rack (as shown in FIG. 5.3). Thus, the front sucker fixing plate can move up and down relative to the transport rack under the action of the suction cylinder; similarly, the back sucker fixing plate is mounted at the back end of the transport rack by the back suction cylinder. Bodies (or piston rods) of two back suction cylinders are fixed on the left and right sides at the back end of the transport rack, wherein they are connected to both ends of the back sucker fixing plate. The back sucker fixing plate can also be driven by the back suction cylinder mounted at the back end of the transport rack. Thus, the back sucker fixing plate can move up and down relative to the transport rack under the action of the suction cylinder. Therefore, the spaced front-row margin trimming sucker kit and the back-row margin trimming sucker kit can move up and down relative to the transport rack.

Two transfer tracks are arranged on the left and right sides of the margin trimming low mold B1-1, wherein such tracks can be directly mounted on the mounting plate of the margin trimming low mold or the rack across the position to be margin trimmed, margin trimming position and the completion position. The transport rack B2.1 can move (slide or roll) back and forth on two transfer tracks through the slider B2.5. Therefore, the spaced front-row margin trimming sucker kit B2.6 and the back-row margin trimming sucker kit B2.7 can move back and forth with the transport rack B2.1. The transport rack can move back and forth horizontally driven by the horizontal driving device B2.10. The horizontal driving device is driven by the motor-driven screw. Namely, it is driven by a motor and a screw mechanism, thus driving the transport rack to move back and forth horizontally or stop at a specific position. The horizontal driving device can also be driven by a motor, synchronous belt or belt or chain to drive the transport rack to move back and forth horizontally or stop at a specific position; or driven by a cylinder or tank to drive the transport rack to move back and forth horizontally or stop at a specific position.

The front-row margin trimming sucker kit and the back-row margin trimming sucker kit are connected to a negative-pressure device (including conventional suction pump, vacuum generator, vacuum pump) respectively by means of a pipe mounted with a control valve, wherein the margin trimming device is mounted with a control switch for opening and closing the control valve so that the sucker is connected to the negative pressure device to generate the negative pressure and absorb the products during product suction, and disconnected from the negative pressure device during product placement so as to relieve the negative pressure of the sucker and place such products.

During operation, the front-row margin trimming sucker kit and the back-row margin trimming sucker kit are arranged above the products to be margin trimmed B10 in the position to be margin trimmed and the positioning block B1-1.2 in the margin trimming position respectively. The front-row margin trimming sucker kit and the back-row margin trimming sucker kit move downward respectively under the action of the front suction cylinder B2.2 and the back suction cylinder B2.9, wherein the front-row margin trimming sucker kit B2.6 and the back-row margin trimming sucker kit move downward respectively and upward to its original position after absorbing the products to be margin trimmed and margin trimmed products. The specific process is: when the front-row margin trimming sucker kit moves downward and contacts the products to be margin trimmed, the control valve on the pipe of the negative pressure device connected to the sucker opens and the sucker is connected to the negative pressure (first connect to the negative pressure before the front-row margin trimming sucker kit B2.6 contacts the products to be margin trimmed B10), wherein the front-row margin trimming sucker kit moves upward to its original position driven by the front suction cylinder B2.2 after withdrawing and absorbing the products to be margin trimmed; when the back-row margin trimming sucker kit moves downward and contacts the margin trimmed products, the control valve on the pipe of the negative pressure device (including conventional suction pump, vacuum generator, vacuum pump) connected to the sucker opens and the sucker is connected to the negative pressure (connect to the negative pressure before the back-row margin trimming sucker kit contacts the margin trimmed products), wherein the back-row margin trimming sucker kit moves upward to its original position driven by the back suction cylinder after withdrawing and absorbing the products to be margin trimmed.

Thus, the spaced front-row margin trimming sucker kit and the back-row margin trimming sucker kit move downward to withdraw and absorb the products to be margin trimmed and margin trimmed products, and upward to its original position. Driven by the horizontal driving device, the transport rack moves backward (W-direction in FIG. 6-1) along the transfer track to deliver the products to be margin trimmed to the margin trimming position from the position to be margin trimmed, the margin trimmed products to the completion position.

Meanwhile, the scrap removal mechanism expels the margin trimmed scrap from the margin trimming position to ensure the positioning accuracy of the next products to be margin trimmed during the process that the margin trimmed products are withdrawn, absorbed and delivered to the completion position.

The front-row margin trimming sucker kit moves below the positioning block of the margin trimming low mold with the products to be margin trimmed, the back-row margin trimming sucker kit just moves to the completion position with the margin trimmed products and the transport rack stops moving. When the control switch gives a signal from the margin trimming machine, the control valve on the pipe of the negative pressure device (including conventional suction pump, vacuum generator, vacuum pump) connected to the front-row margin trimming sucker kit closes, the sucker relieves the negative pressure and the products to be margin trimmed fall onto the positioning block of the margin trimming low mold, meanwhile, the control valve on the pipe of the negative pressure device (including conventional suction pump, vacuum generator, vacuum pump) connected to the back-row margin trimming sucker kit closes, the sucker relieves the negative pressure and the margin trimmed products fall into the completion position. An alternative case is: when the front-row margin trimming sucker kit is arranged above the margin trimming low mold, it moves downward with the products to be margin trimmed, relieves the negative pressure on the sucker, and delivers the products to be margin trimmed onto the positioning block of the margin trimming low mold, wherein the kit moves downward, places the products to be margin trimmed down and moves upward to its original position so that the products to be margin trimmed are delivered to the margin trimming position from the position to be margin trimmed; while the back-row margin trimming sucker kit reaches the completion position, it also moves downward with the margin trimmed products, relieves the negative pressure on the sucker, and delivers the margin trimmed products into the completion position, wherein the kit moves downward, places the margin trimmed products down and moves upward to its original position so that the margin trimmed products are delivered to the completion position from the margin trimming position.

Then, the transport rack returns a certain distance forward driven by the front-row and back-row margin trimming sucker kits, when the spaced front-row and back-row margin trimming sucker kits are in certain position of the margin trimming mold on the front and back sides, the transport rack will drive such kits to stop moving so as to avoid clamping movement of the margin trimming mold. Next, the margin trimming top mold moves downward for clamping, penetrates through the spaced front-row and back-row margin trimming sucker kits and implements clamping and margin trimming for the products. After completion of margin trimming, the margin trimming top mold moves upward, opens appropriately while the margin trimmed products are left onto the margin trimming low mold.

The transport rack continues to returns forward to the original position driven by the front-row and back-row margin trimming sucker kits, so that the front-row margin trimming sucker kit returns above the products to be margin trimmed in the position to be margin trimmed while the back-row margin trimming sucker kit returns above the positioning block in the position to be margin trimmed for withdrawing the next products to be margin trimmed and margin trimmed products. The front-row margin trimming sucker kit B2.6 and the back-row margin trimming sucker kit move downward respectively under the action of the front suction cylinder and the back suction cylinder, wherein the front-row margin trimming sucker kit and the back-row margin trimming sucker kit move downward respectively and upward to its original position after absorbing the products to be margin trimmed and margin trimmed products. The transport rack moves backward again along the transfer track driven by the horizontal driving device for the next cycle repeatedly.

The products are transferred between the position to be margin trimmed, margin trimming position and the completion position progressively and repeatedly, thus completing the processing from the products to be margin trimmed to the margin trimmed products.

The transport rack has a frame structure, wherein such product transfer mechanism can be known as the "Frame-type Product Transfer Mechanism".

In addition, the product transfer mechanism of the margin trimming device B in the embodiment can also be a rod-type product transfer mechanism. As shown in FIGS. 7-6.1 and 7-6.2, the margin trimming device B of the embodiment, the specific structure of its product transfer mechanism is:

The transport rack is a transport rod B19 (also referred to as the rod transport rack) without a frame structure arranged on the left or right side of the margin trimming low mold, wherein the front-row and back-row margin trimming sucker kits are fixed onto the front and back sucker fixing plates respectively with their openings facing downward, one end of the front sucker fixing plate and the back sucker fixing plate is mounted on the transport rack respectively at a distance, a space is left between the front-row and the back-row sucker kit more than the profile of the margin trimming top mold. The transport rod can be slidably fixed on two swing devices B17, comprising a swing cylinder B17.3, a swing sleeve guide B17.2, a swing rod B17.4, a swing sleeve B17.1, wherein the transport rod can be slidably fixed on the swing sleeve B17.1, the swing sleeve can be slidably fixed on the swing sleeve guide and move up and down along the swing sleeve guide B17.2 driven by the swing cylinder B17.3, thus driving the transport rod to move up and down; the swing sleeve can be driven by the swing cylinder B17.3 via the swing rod B17.4; the swing sleeve can also be directly driven by the swing cylinder B17.3. Therefore, the transport rod can move back and forth horizontally in the two swing devices (as shown by the arrow B in FIG. 7-6.1), which in turn will drive the transport rod to move up and down, wherein the transport rod can be slidably fixed on the slide B18 of the transfer track B2.4 via the sliding connection B20 and move up and down relative to the slide, the slide can move horizontally along two transfer tracks driven by the horizontal driving device B2.10 or stop at a specific position, then drive the transport rod to move horizontally via the sliding connection or stop at a specific position. Therefore, the transport rod can drive the front-row and back-row margin trimming sucker kits to move horizontally or stop at a specific position. The two transfer tracks can be arranged vertically or horizontally. The transport rod can move back and forth horizontally driven by the horizontal driving device B2.10. The horizontal driving device is driven by the motor-driven screw. Namely, it is driven by a motor and a screw mechanism, thus driving the transport rod to move back and forth horizontally or stop at a specific position. The horizontal driving device can also be driven by a motor, synchronous belt or belt or chain to drive the transport rod to move back and forth horizontally or stop at a specific position; or driven by a cylinder or tank to drive the transport rod to move back and forth horizontally or stop at a specific position. Such product transfer mechanism can be known as the "Rod-type Product Transfer Mechanism". As shown by the arrow Y in FIG. 7-6.1, the products are transferred from the position to be margin trimmed, margin trimming position to the completion position progressively, the method and principle of transferring products are the same as the frame-type product transfer mechanism.

After completion of clamping margin trimming, the scrap B12 and the margin trimmed products all leave in the margin trimming low mold, wherein such scrap requires being removed of the margin trimming low mold without affecting the effect of the next margin trimming. The scrap shall be removed by the scrap removal device.

As shown in FIGS. 7-6.3 and 7-7, a scrap blowing rod B14 is mounted on the transport rack B2.1 between the front-row margin trimming sucker kit and the back-row margin trimming sucker kit or transport rod (B19) or other positions, wherein the scrap blowing rod moves back and forth horizontally with the front-row and back-row margin trimming sucker kits. The scrap blowing rod is connected to the compressed air (including the compressed air and air flow generated by the compressor or conventional fan or pump) via a pipe mounted with a control valve, wherein the margin trimming device is also mounted with a control switch for opening and closing the control valve so as to open the control valve and turn on the compressed air during blowing of the scrap, close the control valve and turn off the compressed air during stopping blowing of the scrap. The scrap blowing rod blows while moving to blow the scrap off the margin trimming low mold within a period of time when the back-row margin trimming sucker kit absorbs and moves the margin trimmed products to the completion position. Repeat the cycle and remove the scrap consequently.

For products with different structures, the scrap removal device can also adopt the flowing several structures:

1. The scrap can be transferred with a scrap sucker kit, as shown in FIGS. 7-5.4.2 and 7-6.4, a set of scrap sucker kits B2.7-1 can also be mounted near the back-row margin trimming sucker kit B2.7 for withdrawing and absorbing the scrap left on the margin trimming low mold, and delivering the scrap out of the margin trimming low mold. The scrap sucker kit can rise or fall synchronously or mounted on the same fixing plate with the back-row margin trimming sucker kit. Like the back-row margin trimming sucker kit, the scrap sucker kit is connected to the negative pressure device (including conventional suction pump, vacuum generator, vacuum pump) separately via a pipe mounted with a control valve, wherein the margin trimming device B is also mounted with a control switch to open and close the control valve so as to generate negative pressure during scrap withdrawing and absorbing via the scrap sucker kit and relieve negative pressure during scrap relieving. The action of the scrap sucker kit for absorbing and transferring the scrap is similar to that of the back-row margin trimming sucker kit for absorbing and transferring the margin trimmed product left on the margin trimming low mold. After completion of clamping margin trimming, the scrap and the margin trimmed product are all left on the margin trimming low mold, when the back-row margin trimming sucker kit withdraws and absorbs the margin trimmed product left on the margin trimming low mold, the scrap sucker kit also withdraws and absorbs the scrap left on the margin trimming low mold synchronously. During delivering to the completion position, the scrap sucker kit closes the control valve on the pipe of the negative pressure device (including conventional suction pump, vacuum generator, vacuum pump) it is connected to, and then closes the control valve on the pipe of the negative pressure device (including conventional suction pump, vacuum generator, vacuum pump) the back-row margin trimming sucker kit is connected to after arriving at the completion position, thus making the products fall into the completion position. To ensure that the margin trimmed product is separated from the scrap, the scrap sucker kit will first eliminate the negative pressure when the product and the scrap are delivered out of the margin trimming mold, make the scrap to fall before the product arrives at the completion position, and then the back-row sucker kit continues to move backward to arrive at the completion position with the product. The scrap and the margin trimmed product fall into two different positions to achieve the purpose of separating the scrap from the margin trimmed product.

2. As shown in FIGS. 7-3 and 7-4, a set of pliers B13 or hooks or clamps are arranged on the front and back sides of the margin trimming low mold, or a set of pliers or hooks or clamps are arranged on either side (the front or back side) of the margin trimming low mold. After completion of clamping margin trimming, the scrap is separated from the margin trimmed product. After opening of the margin trimming mold, the pliers or clamp or hook moves to the scrap for clamping driven by the moving cylinder (or other power) and then withdraws to drag the scrap off the margin trimming low mold, when the scrap is removed from the margin trimming low mold, the pliers or clamp or hook will open to drop the scrap into the scrap collector or box on either or two sides of the margin trimming low mold; if the scrap has a closed-loop structure, disconnect such closed-loop scrap or trim the scrap into two or several segments for dragging when margin trimming.

3. The scrap can also be removed by means of the vacuum method. A scrap suction nozzle is mounted on both sides of the margin trimming low mold and connected to the negative pressure device (including conventional suction pump, vacuum pump), wherein the scrap is margin trimmed into two or several segments in the margin trimming mold. After mold opening, the scrap suction nozzle is connected to the negative pressure device (including conventional suction pump, vacuum generator, vacuum pump) to remove the scrap or absorb the scrap for dragging away.

What is claimed is:

1. A full-automatic method for manufacturing plant-fiber molding products, comprising the steps of:

Step 1: pulps are continuously made into wet semifinished product by means of a suck-filter forming device, the wet semifinished product is alternatively fed into hot-press molds of a left hot press mold solidifying device and a right hot press mold solidifying device after being heated to a certain temperature for hot-press drying and solidifying, wherein dried and solidified products are fed into a left positioning collection tray of a left positioning collection device and a right positioning collection tray of a right positioning collection device respectively from a left hot-press top mold and a right hot-press top mold, and are positioned therein, to achieve the purpose of fixing the dried and solidified products in a specific position for transfer and ensure the transfer accuracy of the dried and solidified products to be margin trimmed;

Step 2: the left positioning collection device delivers the dried and solidified products to be margin trimmed to a left transition station and the right positioning collection device delivers the dried and solidified products to be margin trimmed to a right transition station; the products to be margin trimmed are transferred to position to be margin trimmed of a margin trimming device by a transfer device positioned on the left transition station and the right transition station, and then the margin trimming device withdraws the products to be margin trimmed from the position to be margin trimmed, delivers the products to the margin trimming position for margin trimming, and then delivers margin trimmed products to a destination position and expels or removes margin trimmed scrap from the margin trimming position; and repeating the Steps 1 and 2.

2. The full-automatic method for manufacturing plant-fiber molding products according to claim 1, wherein that a left discharge sucker kit in the transfer device withdraws and absorbs the products to be margin trimmed in the left positioning collection tray on the left transition station through vacuum absorption, delivers such products above a left product receiving station along a left discharge horizontal track, and then to a left storage flipper for realization of flipping the products to be margin trimmed or directly to a positioning tray to be margin trimmed in a left transport vehicle on the left product receiving station; a right discharge sucker kit in the transfer device withdraws and absorbs the products to be margin trimmed in the right positioning collection tray on the right transition station through vacuum absorption, delivers such products to a right product receiving station along a right discharge horizontal track, and then to a right storage flipper for realization of flipping the products to be margin trimmed or directly to the positioning tray to be margin trimmed in a right transport vehicle on the right product receiving station, so that the products to be margin trimmed are re-positioned in the positioning tray to be margin trimmed.

3. The full-automatic method for manufacturing plant-fiber molding products according to claim 2, wherein the left transport vehicle in the transfer device receives the products to be margin trimmed on the left product receiving station and delivers them to the position to be margin trimmed; the right transport vehicle in the transfer device receives the products to be margin trimmed on the right product receiving station and delivers them to the position to be margin trimmed, wherein the left and right transport vehicles alternatively deliver the received products to be margin trimmed to the position to be margin trimmed.

4. The full-automatic method for manufacturing plant-fiber molding products according to claim 3, wherein the margin trimming device withdraws the products to be margin trimmed from the position to be margin trimmed, delivers them to the margin trimming position for margin trimming, and then delivers the margin trimmed products to the destination position.

5. The full-automatic method for manufacturing plant-fiber molding products according to claim 4, wherein margin trimming molds are mounted in the margin trimming and a clamping mechanism of the margin trimming device, comprising a margin trimming top mold and a margin trimming low mold, wherein a positioning block is arranged on the margin trimming low mold to fit the shape of products for determining the product position on the margin trimming low mold.

6. The full-automatic method for manufacturing plant-fiber molding products according to claim 5, wherein the margin trimming device delivers the products from the position to be margin trimmed to the margin trimming position, and then to the destination position, of which the process is completed through product withdrawing and absorption with a margin trimming sucker kit.

7. The full-automatic method for manufacturing plant-fiber molding products according to claim 6, wherein the margin trimming sucker kit is divided into two spaced kits, the two spaced kits comparing a front-row margin trimming sucker kit and a back-row margin trimming sucker kit, wherein the front-row margin trimming sucker kit absorbs the products to be margin trimmed on the position to be margin trimmed placed on the front side of the margin trimming mold and transfers them onto the positioning block of the margin trimming low mold, the back-row margin trimming sucker kit absorbs the margin trimmed products on the positioning block of the margin trimming low mold and delivers them out of the margin trimming mold, and then places them on the destination position on a back side of the margin trimming mold.

8. The full-automatic method for manufacturing plant-fiber molding products according to claim 7, further comprising the following steps performed by the margin trimming device:

1) the front-row margin trimming sucker kit, on top of the position to be margin trimmed, moves down to absorb the products to be margin trimmed and moves up to return its original position, while the back-row margin trimming sucker kit, on top of the positioning block of the margin trimming low mold, moves down to absorb the margin trimmed products and moves up to return its original position;
2) the front-row margin trimming sucker kit and the back-row margin trimming sucker kit move backward horizontally with the products withdrawn, a scrap removal mechanism expels the margin trimmed scrap from the margin trimming position;
3) after moving backward horizontally to some distance, a front-row margin trimming sucker kit and a back-row margin trimming sucker kit release the products withdrawn respectively, making the products to be margin trimmed fall onto the margin trimming position while the margin trimmed products onto the destination position; the front-row margin trimming sucker kit and the back-row margin trimming sucker kit move forward horizontally and simultaneously, and then stop horizontal movement when the spaced front-row margin trimming sucker kit and the back-row margin trimming sucker kit are in a position on the front and back side of the margin trimming mold respectively;
4) the margin trimming top mold moves downward from the margin trimming mold to clamp with the margin trimming low mold and remove the rough edges of the products to be margin trimmed; and then the margin trimming top mold moves upward from the margin trimming mold to open the mold;
5) the front-row margin trimming sucker kit and the back-row margin trimming sucker kit continue to move forward horizontally until the front-row margin trimming sucker kit and the back-row margin trimming sucker kit reach to the top of the position to be margin trimmed and the margin trimming position respectively;
6) the front-row margin trimming sucker kit and the back-row margin trimming sucker kit moves down respectively or simultaneously to absorb the products to be margin trimmed and the margin trimmed products and then moves up to return its original position;

then repeat steps 2) to 6).

9. The full-automatic method for manufacturing plant-fiber molding products according to claim 8, further comprising using a piece or set of scrap blowing rods to move back and forth horizontally with the front-row margin trimming sucker kit and the back-row margin trimming sucker kit, wherein the scrap blowing rod blows or moves and blows to blow the scrap off the margin trimming low mold within a period of time when the back-row margin trimming sucker kit absorbs and moves the margin trimmed products to the destination position, without affecting the positioning of the next products to be margin trimmed on the positioning block.

10. The full-automatic method for manufacturing plant-fiber molding products according to claim 8, wherein the scrap sucker kit absorbs the margin trimmed scrap from the margin trimming mold and then removes it out of the margin trimming mold without affecting the positioning of the next products to be margin trimmed on the positioning block.

* * * * *